US012098910B2

(12) United States Patent
Uchida et al.

(10) Patent No.: US 12,098,910 B2
(45) Date of Patent: Sep. 24, 2024

(54) WIRELESS DETONATION SYSTEM, RELAY DEVICE FOR WIRELESS DETONATION SYSTEM, AND WIRELESS DETONATION METHOD USING WIRELESS DETONATION SYSTEM

(71) Applicants: NOF Corporation, Tokyo (JP); Futaba Corporation, Mobara (JP)

(72) Inventors: Kohki Uchida, Aichi-ken (JP); Naoto Yanagi, Aichi-ken (JP); Toshiyuki Ogura, Aichi-ken (JP); Kohichi Shimazaki, Mobara (JP); Kazuhito Watanabe, Mobara (JP); Takafumi Komoda, Mobara (JP)

(73) Assignees: NOF Corporation, Tokyo (JP); Futaba Corporation, Mobara (JP)

( * ) Notice: Subject to any disclaimer, the term of this patent is extended or adjusted under 35 U.S.C. 154(b) by 120 days.

(21) Appl. No.: 18/015,758

(22) PCT Filed: Jul. 12, 2021

(86) PCT No.: PCT/JP2021/026119
§ 371 (c)(1),
(2) Date: Jan. 12, 2023

(87) PCT Pub. No.: WO2022/014530
PCT Pub. Date: Jan. 20, 2022

(65) Prior Publication Data

US 2023/0287791 A1 Sep. 14, 2023

(30) Foreign Application Priority Data

Jul. 13, 2020 (JP) ..... 2020-119793

(51) Int. Cl.
*F42D 1/045* (2006.01)
*E21D 9/00* (2006.01)
(Continued)

(52) U.S. Cl.
CPC ..... *F42D 1/045* (2013.01); *E21D 9/006* (2013.01); *F42D 3/04* (2013.01); *F42B 3/12* (2013.01)

(58) Field of Classification Search
CPC ..... F42D 1/00; F42D 1/04; F42D 1/045; F42D 1/05; F42D 3/04; F42B 3/12; E21D 1/00; E21D 9/006
(Continued)

(56) References Cited

U.S. PATENT DOCUMENTS 7,791,858 B2 * 9/2010 Hummel ..... F42D 1/05 361/247
7,929,270 B2 * 4/2011 Hummel ..... F42D 3/04 361/249
10,113,843 B2 * 10/2018 Appleby ..... F42B 3/11
10,584,949 B2 * 3/2020 Tasaki ..... H02J 50/10
(Continued)

FOREIGN PATENT DOCUMENTS

EP 1842026 A1 10/2007
JP 2001-330400 A 11/2001
(Continued)

OTHER PUBLICATIONS

Translation of International Preliminary Report on Patentability for PCT/JP2021/026119 (Year: 2023).*
(Continued)

*Primary Examiner* — James S Bergin
(74) *Attorney, Agent, or Firm* — Amster, Rothstein & Ebenstein LLP

(57) ABSTRACT

A wireless detonation system (1) includes a blasting operation device (40), a detonator (10), and a relay device (30). The blasting operation device (40) is disposed at a distance from a blasting face (71) and wirelessly transmits a first downstream signal at a first frequency. The detonator (10) is loaded in a blast hole (72) in the blasting face (71), and has a receiving coil (12) for wirelessly receiving a second
(Continued)

downstream signal at a second frequency lower than the first frequency. A relay device (30) includes a first transmitting-receiving antenna (35) that wirelessly receives the first downstream signal, a relay processor (32) that wirelessly receives the first downstream signal and processes it into the second downstream signal to be wirelessly transmitted at the second frequency, and a second transmitting-receiving antenna (37) that transmits the second downstream signal. The second transmitter-receiver antenna (37) is loaded into an insertion hole (74) in the blasting face (71) aligned with the blast hole (72).

20 Claims, 13 Drawing Sheets

(51) Int. Cl.
*F42D 3/04* (2006.01)
*F42B 3/12* (2006.01)

(58) Field of Classification Search
USPC ..... 102/206, 214
See application file for complete search history.

(56) References Cited

U.S. PATENT DOCUMENTS

| | | | | |
|---|---|---|---|---|
| 11,441,883 | B2 * | 9/2022 | Maurissens | F42D 1/02 |
| 2005/0030695 | A1 | 2/2005 | Meyer et al. | |
| 2008/0041261 | A1 | 2/2008 | Hummel et al. | |
| 2017/0074630 | A1 | 3/2017 | Kotsonis et al. | |

FOREIGN PATENT DOCUMENTS

| | | | |
|---|---|---|---|
| JP | 5630390 | B2 | 11/2014 |
| JP | 2017-510785 | A | 4/2017 |
| JP | 2020010246 | A | 1/2020 |
| WO | 03-029748 | A1 | 4/2003 |

OTHER PUBLICATIONS

Chinese Office Action dated Apr. 18, 2024 issued in Chinese Patent Application No. 202180048951.4 (with English language machine translation).

International Search Report and Written Opinion dated Sep. 28, 2021 issued in PCT International Application No. PCT/JP2021/026119 (in Japanese language, with English language translation of International Search Report attached).

* cited by examiner

WIRELESS DETONATION SYSTEM, RELAY DEVICE FOR WIRELESS DETONATION SYSTEM, AND WIRELESS DETONATION METHOD USING WIRELESS DETONATION SYSTEM

CROSS-REFERENCE TO RELATED APPLICATIONS

This application is a U.S. national stage entry under 35 U.S.C. § 371 of PCT International Patent Application No. PCT/JP2021/026119, filed Jul. 12, 2021, which claims priority to Japanese Patent Application No. 2020-119793, filed Jul. 13, 2020, the contents of each of which are hereby incorporated by reference in their entirety.

TECHNICAL FIELD

An embodiment of the present disclosure relates to a wireless detonation system for use at excavation sites, such as tunnels, crushing sites for rocks, etc., and demolition sites for structures such as buildings. In addition, the embodiment of the present disclosure relates to a relay device for the wireless detonation system and a wireless detonation method using the wireless detonation system.

BACKGROUND ART

A wireless detonation system used in blasting work at a tunnel excavation site, etc. has a wireless detonator and a blasting operation device. The wireless detonator is loaded with explosives into a plurality of blast holes drilled in the excavation direction through the blasting face. For example, the blast hole has a diameter of several centimeters and a depth of several meters. The blasting operation device is disposed at a remote location away from the blasting face. The wireless detonator and the blasting operation device each has a transmitting-receiving antenna.

For example, Japanese Patent No. 5630390 describes a wireless detonation system may have an antenna on a blasting operation device side, which is disposed in the vicinity of the blasting face. The antenna on the blasting operation device side is disposed, for example, at a position about 1 meter away from the blasting face. The antenna may be formed in a loop-shape having a size such that it surrounds a plurality of blast holes on the blasting face. The antenna on the blasting operation device side wirelessly transmits control signals, including energy for driving the wireless detonator, and detonation signals to the wireless detonator. An explosive-side antenna receives energy for driving and receives control signals from the blasting operation device. The energy for driving is accumulated in a storage element of the wireless detonator. The wireless detonator uses radio waves to transmit a response signal, including its own operating state, based on the control signal via the explosive-side antenna. The radio wave is received by the blasting operation device via an antenna. The blasting operation device recognizes that charging of the wireless detonator has been completed based on the response signal. Then, the blasting operation device transmits a detonation signal to the wireless detonator, which detonates the explosive.

The antenna on the blasting operation device side transmits energy for driving from outside the blasting face to the explosive-side antenna in the blast hole. The wireless detonation systems disclosed in Japanese Patent No. 5630390 and Japanese Patent No. 4309001 have a large antenna on the blasting operation device side, which is disposed in the vicinity of the blasting face. The wireless detonation system disclosed in Japanese Patent No. 6612769 includes a large antenna on the blasting operation device side at the ignition location. Therefore, it was troublesome to dispose a large antenna on the blasting operation device side. In addition, there are restrictions on the place where the antenna on the blasting operation device side can be disposed, and there are cases where the workability is not good.

The antenna on the blasting operation device side transmits energizing energy and control signals to the explosive-side antenna through a bedrock. The antennas on the blasting operation device side disclosed in Japanese Patent No. 5630390, Japanese Patent No. 4309001, and Japanese Patent No. 6612769 transmit energizing energy and control signals using a relatively large power (for example, exceeding several Watts) and at a low frequency of, for example, 1 kHz to 500 kHz, which easily penetrates the bedrock. Therefore, in some cases, countermeasures, such as electromagnetic wave shielding, are required to prevent electromagnetic waves from leaking out of the tunnel.

DISCLOSURE OF THE INVENTION

Problem to be Solved by the Invention

For example, Japanese Patent Application Laid-Open No. 2019-66092 discloses a wireless detonation system may have an auxiliary antenna drawn out from a wireless detonator to be positioned outside a blast hole. Thereby, the antenna on the blasting operation device side and the explosive-side antenna can transmit and receive electromagnetic transmissions at high frequencies of, for example, 1 MHz to 10 GHz, which are difficult to pass through the bedrock. However, using this method, it is necessary to pull out an auxiliary antenna for each wireless detonator, which complicates the loading operation of the wireless detonator. Therefore, there is a need for a wireless detonation system which allows for efficient placement of communication equipment between the antenna on the blasting operation device side and the antenna on the explosives side. Furthermore, there is a need for preventing the signals transmitted and received by the antenna on the blasting operation device side and the antenna on the explosives side from leaking to the surroundings.

Means for Solving the Problem

According to one aspect of the present disclosure, a wireless detonation system includes a blasting operation device, a detonator, and a relay device. The blasting operation device is disposed distanced from a blasting target and is configured to wirelessly transmit a first downstream signal at a first frequency. The detonator is loaded in the blast hole of the blasting target and includes an explosive-side receiving antenna configured to wirelessly receive a second downstream signal at the second frequency lower than the first frequency. The relay device includes a first receiving antenna to wirelessly receive the first downstream signal and a relay processor that processes to wirelessly receive the first downstream signal and processes to wirelessly transmit the second downstream signal at the second frequency. The relay device also includes a second transmitting antenna to wirelessly transmit the second downstream signal. The second transmitting antenna is loaded into an insertion hole of the blasting target aligned with the blast hole.

Therefore, the relay device and the detonator communicate wirelessly at the second frequency, which is a relatively low frequency. The relay device and the detonator may communicate wirelessly at a low frequency that penetrates, for example, a bedrock constituting a blasting target. Since both of the relay device and the detonator are placed in the holes formed in the blasting face, they are positioned close to each other. Therefore, the relay device and the detonator can wirelessly communicate with each other using signals with a small power of, for example, less than or equal to 10 W. On the other hand, the relay device and the blasting operation device communicate wirelessly using a first frequency, which is a relatively high frequency. Therefore, it is possible to prevent signals from leaking to the surroundings, such as outside the tunnel, of a blasting target.

According to another aspect of the present disclosure, the detonator includes an explosive-side transmitting antenna to wirelessly transmit a second upstream signal at the second frequency. The relay device includes a second transmitting antenna to wirelessly transmit a second upstream signal, a relay processor that processes to wirelessly receive the second upstream signal and processes to wirelessly transmit the first upstream signal at the first frequency, and a first transmitting antenna to wirelessly transmit the first upstream signal. The blasting operation device is configured to wirelessly receive the first upstream signal. Therefore, the above-mentioned effect can be wirelessly obtained not only with the downstream signal transmitted from the blasting operation device to the detonator via the relay device, but also with the upstream signal in the opposite direction.

According to another aspect of the present disclosure, the explosive-side receiving antenna and the explosive-side transmitting antenna are a common antenna. The first receiving antenna and the first transmitting antenna are a common antenna. The second receiving antenna and the second transmitting antenna are a common antenna. Therefore, the number of parts of the entire wireless detonation system can be reduced.

According to another aspect of the present disclosure, the relay device has a housing which is partially or entirely inserted into the insertion hole. The first receiving antenna, the second transmitting antenna, and the relay processor are integrally provided in the housing. Alternatively, the relay device may include a plurality of housings which may be inserted into the insertion holes. The first receiving antenna may be provided to any of the plurality of housings. The second transmitting antenna may be provided to any of the plurality of housings. The relay processor may be provided to any of the plurality of housings. Therefore, the relay device is supported by the blasting target via the housing. This allows the relay device to be easily inserted into and supported by the blasting target.

According to another aspect of the present disclosure, the housing includes a rear end provided at the rear side of the insertion hole. The second transmitting-receiving antenna is provided at the rear end. The first receiving antenna is provided at the front end of the housing opposite to the rear end. Therefore, the second transmitting antenna is positioned at a location close to the detonator, which has been loaded in the rear side of the blast hole. Therefore, the relay device and the detonator can communicate with each other using low power signals. On the other hand, the first receiving antenna is positioned at a location close to the opening of the insertion hole. Therefore, the first receiving antenna can wirelessly communicate with the blasting operation device using signals that are not substantially interrupted by a bedrock, etc. constituting a blasting target.

According to another aspect of the present disclosure, the first receiving antenna is disposed in the front end of the housing, with the first receiving antenna projecting through the insertion hole and/or beyond the blasting face. Therefore, the relay device and the blasting operation device can wirelessly communicate with each other using signals that are not substantially interrupted by the bedrock, etc. constituting the blasting target. Further, the first receiving antenna projects from the blasting target using the housing held at the blasting target. The first receiving antenna is thus supported by the blasting target using a simple structure.

According to another aspect of the present disclosure, the second frequency may be within the range of 1 kHz to 500 kHz, which is a frequency range that penetrates the bedrock. The first frequency may be within the range of 1 MHz to 10 GHz. Therefore, the relay device and the detonator can communicate well wirelessly within the bedrock. Further, the frequency bands of the first frequency and the second frequency are separated from each other. Interference between signals at the first frequency and signals at the second frequency can thus be reduced, thereby further preventing erroneous communication.

According to another aspect of the present disclosure, a detonator loading unit is provided to load the detonator into the blast hole. The detonator loading unit includes a loading-unit-side communication device capable of communicating with the explosive-side receiving antenna of the detonator. This communication may occur before the detonator is loaded into the blast hole and using radio signals at the second frequency. Therefore, a process to allow for communication between the detonator and the loading-unit-side communication device and a process to load the detonator into the blast hole can be efficiently performed in a series of flows. Further, the explosive-side receiving antenna receiving from the loading-unit-side communication device and the explosive-side receiving antenna receiving from the relay device can be used in common. It is thus possible to reduce the number of parts of the detonator.

According to another aspect of the present disclosure, the detonator includes a receiving coil to receive energy for driving the detonator and a capacitor to accumulate the energy for driving. The detonator loading unit includes a power supplying coil that feeds energy to the receiving coil of the detonator to drive the detonator before it is loaded into the blast hole. The capacitor of the detonator can thus maintain a state in which the energy necessary for driving the detonator is not accumulated or is low until immediately before the detonator is loaded in the blast hole. Therefore, when transporting the detonator to the blasting target, it can be transported in a stable state without having detonatable energy. The power is supplied to the detonator immediately before being loaded into the blast hole. It is thus possible to use a relatively small capacity capacitor. As a result, the cost of the detonator can be reduced. It is also possible to shorten the amount of time needed to supply power to the capacitor, which allows work to be done more efficiently.

According to another aspect of the present disclosure, the relay device includes a receiving coil to receive energy for driving the relay device from the power supplying coil of the detonator loading unit and includes a capacitor to store the energy for driving. Therefore, electric power can also be supplied to the relay device using the power supplying coil as the one that feeds the electric power to the detonator. It is thus possible to reduce the number of parts of the entire system. Further, the electric power is stored in the capacitor immediately before inserting the relay device into the insertion hole. The storage capacity of the capacitor can thus be reduced to the minimum amount required for communication.

According to another aspect of the present disclosure, the detonator loading unit is provided to an explosive delivery unit, which is configured to deliver explosives to be loaded in the blast holes. Therefore, a process to load the detonators into the blast holes and a process to load the explosives in a further front side of the blast holes than the detonators can be efficiently performed in a series of flows.

According to another aspect of the present disclosure, the relay device for the wireless detonation system includes the first receiving antenna, the relay processor, and the second transmitting antenna. The first receiving antenna wirelessly receives a first downstream signal at the first frequency from the blasting operation device disposed distanced from the blasting target. The relay processor processes to wirelessly receive the first downstream signal and processes to wirelessly transmit a second downstream signal at the second frequency lower than the first frequency. The second transmitting antenna wirelessly transmits a second downstream signal to the explosive-side receiving antenna of the detonator, which has been loaded in the blast hole of the blasting target. The first receiving antenna, the relay processor, and the second transmitting antenna are attached to the housing. The housing is loaded in an insertion hole of the blasting target aligned with the blast hole.

Therefore, the relay device and the detonator can communicate wirelessly with each other at the second frequency, which is a relatively low frequency. For example, the relay device and the detonator communicate wirelessly at a low frequency that penetrates a bedrock, etc. constituting a blasting target. Since both the relay device and the detonator are placed in the holes formed in the blasting target, they are positioned close to each other. Therefore, the relay device and the detonator can wirelessly communicate with each other using signals with a small power of, for example, less than or equal to 10 W. On the other hand, the relay device and the blasting operation device communicate wirelessly with a first frequency, which is a relatively high frequency. Therefore, it is possible to prevent signals from leaking to the surroundings, such as outside the tunnel, of a blasting target.

According to another aspect of the present disclosure, the relay device for the wireless detonation system includes a second receiving antenna, a relay processor, and a first transmitting antenna. The second receiving antenna wirelessly receives a second upstream signal transmitted from the detonator at the second frequency. The relay processor processes to wirelessly receive the second upstream signal and processes to wirelessly transmit the first upstream signal at the first frequency. The first transmitting antenna wirelessly transmits the first upstream signal. The second receiving antenna, the relay processor, and the first transmitting antenna are attached to the housing. Therefore, the above-mentioned effect can be wirelessly obtained not only with the downstream signal transmitted from the blasting operation device to the detonator via the relay device, but also with the upstream signal in the opposite direction.

According to another aspect of the present disclosure, the first receiving antenna and the first transmitting antenna are a common antenna. The second receiving antenna and the second transmitting antenna are a common antenna. Therefore, the number of parts of the entire wireless detonation system can be reduced.

According to another aspect of the present disclosure, the second transmitting antenna is provided at a rear end of the housing disposed at the rear side of the insertion hole. The first receiving antenna is provided at a front end of the housing opposite to the rear end. Therefore, the second transmitting antenna is positioned at a location close to the detonator loaded in the rear side of the blast hole. Therefore, the relay device and the detonator can communicate with each other using signals with smaller power. On the other hand, the first receiving antenna is positioned at a location close to the opening of the insertion hole. Therefore, the first receiving antenna can wirelessly communicate with the blasting operation device using signals relatively that are not substantially interrupted by a bedrock, etc. constituting a blasting target.

According to another aspect of the present disclosure, the front end of the housing and the first receiving antenna pass through the insertion hole and project from the blasting target. Therefore, the relay device and the blasting operation device can wirelessly communicate with each other using signals that are not substantially interrupted by the bedrock, etc. constituting the blasting target. Further, the first receiving antenna projects from the blasting target using the housing held by the blasting target. The first receiving antenna is thus supported to the blasting target with a simple structure.

According to another aspect of the present disclosure, the second frequency is within a frequency range of 1 kHz to 500 kHz, which penetrates the bedrock. The first frequency is within a frequency range of 1 MHz to 10 GHz. Therefore, the relay device and the detonator can communicate well wirelessly through the bedrock. Further, the frequency bands at the first frequency and the second frequency are separated from each other. Interference between signals at the first frequency and signals at the second frequency can thus be reduced and erroneous communication can be prevented.

Another aspect of the present disclosure relates to a wireless detonation method using the wireless detonation system. The blasting operation device is disposed in a position distanced from the blasting target. The relay device is disposed within the insertion hole of the blasting target. The blasting operation device and the first antenna of the relay device wirelessly communicate with each other using signals at the first frequency within the range of 1 MHz to 10 GHz. The detonator is disposed within the blast hole of the blasting target. The detonator and the second antenna of the relay device wirelessly communicate with each other using signals at the second frequency within the range of 1 kHz to 500 kHz. The relay processor of the relay device processes to receive the first frequency signals and processes to transmit the second frequency signals. Further, the relay processor of the relay device processes to receive the second frequency signals and processes to transmit the first frequency signals.

Since the relay device and the detonator wirelessly communicate with each other using signals within the range of, for example, 1 kHz to 500 kHz, their signals are able to penetrate the bedrock, etc. constituting the blasting target. Since both the relay device and the detonator are disposed in the holes formed in the blasting target, they are positioned at locations close to each other. Therefore, the relay device and the detonator can wirelessly communicate with each other using signals with a small power of, for example, less than or equal to 10 W. On the other hand, the relay device and the blasting operation device wirelessly communicate using signals within a relatively high range of, for example, 1 MHz to 10 GHz. Therefore, it is possible to prevent signals from leaking to the surroundings, such as outside the tunnel, of a blasting target.

According to another aspect of the present disclosure, the blasting operation device wirelessly transmits the first downstream signal at the first frequency to the relay device. The relay processor of the relay device processes to wirelessly receive the first downstream signal and processes to wirelessly transmit the second downstream signal at the second frequency. The relay device wirelessly transmits the second downstream signal to the detonator. Therefore, the downstream signal at the first frequency, which is to be wirelessly transmitted from the blasting operation device to the relay device, is prevented from leaking to the surroundings, such as outside the tunnel, of a blasting target. The downstream signal at the second frequency, which is to be wirelessly transmitted from the relay device to the detonator, penetrates the bedrock, etc. constituting the blasting target. Therefore, the downstream signal can be favorably wirelessly transmitted from the blasting operation device to the detonator via the relay device.

According to another aspect of the present disclosure, the detonator wirelessly transmits the second upstream signal to the relay device at the second frequency. The relay processor of the relay device processes to wirelessly receive the second upstream signal and processes to wirelessly transmit the first upstream signal at the first frequency. The relay device wirelessly transmits the first upstream signal to the blasting operation device. Therefore, the above-mentioned effect can be wirelessly obtained not only with the downstream signal transmitted from the blasting operation device to the detonator via the relay device, but also with the upstream signal in the opposite direction.

According to another aspect of the present disclosure, a detonator loading unit wirelessly feeds electric power to the detonator and the relay device while in the vicinity of the blasting target. The detonator loading unit loads the energized detonator into the blast hole of the blasting target. The detonator loading unit loads the energized relay device into the insertion hole of the blasting target. Therefore, a process to charge the detonator and to load the detonator into the blast hole and/or a process to charge the relay device and to load the relay device into the insertion hole can be efficiently performed in the vicinity of the blasting face in a series of flows. The power is supplied to the detonator immediately before the detonator is loaded into the blast hole and/or to the relay device immediately before the relay device loaded into the insertion hole. It is thus possible to use energy storage circuits such as a capacitor having a relatively small capacity. As a result, the cost of the detonator and the relay device can be reduced.

EMBODIMENTS FOR CARRYING OUT THE INVENTION

Figure 1:
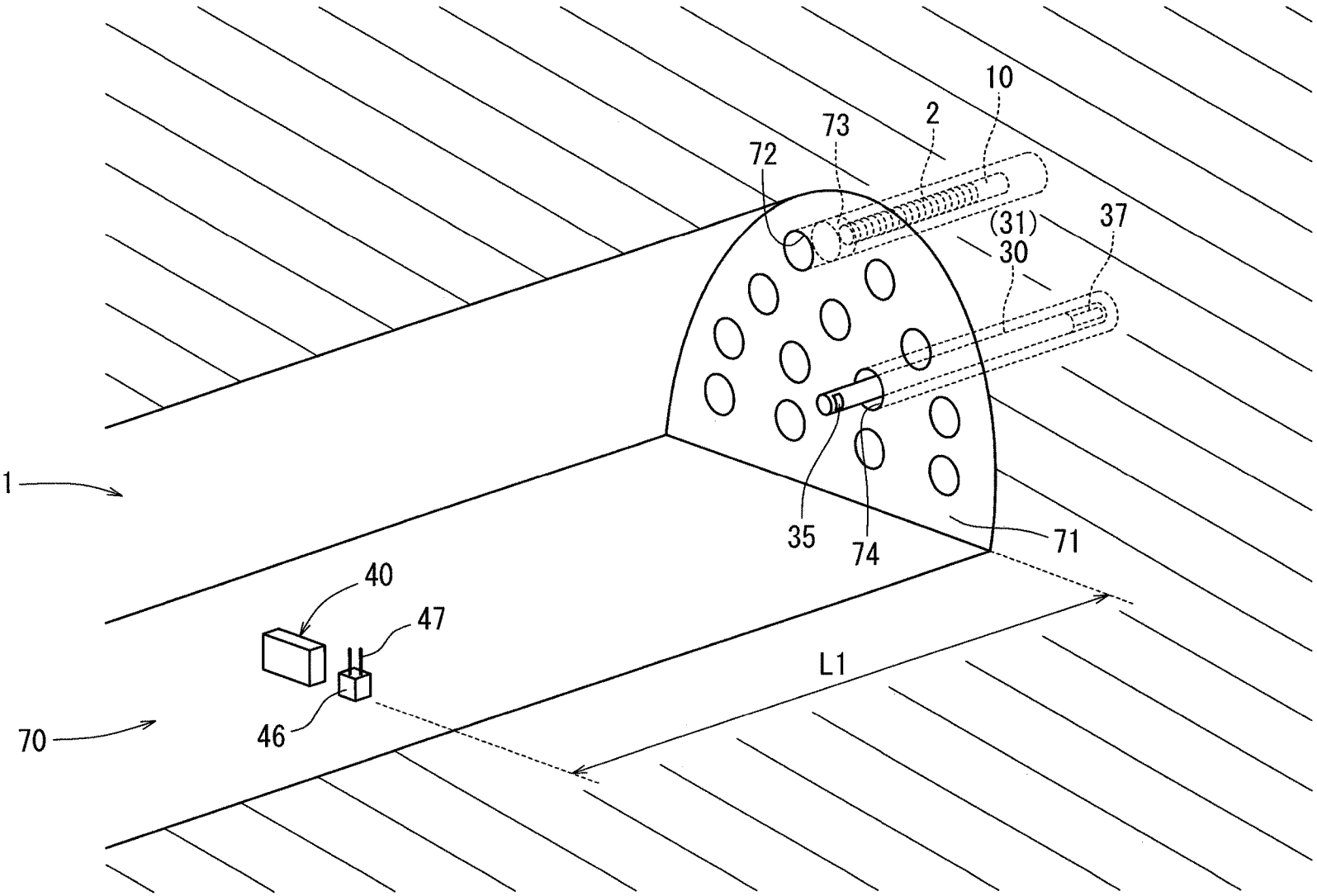
FIG. 1 is a schematic diagram of the entire configuration of a wireless detonation system and a tunnel excavation site.
Figure 2:
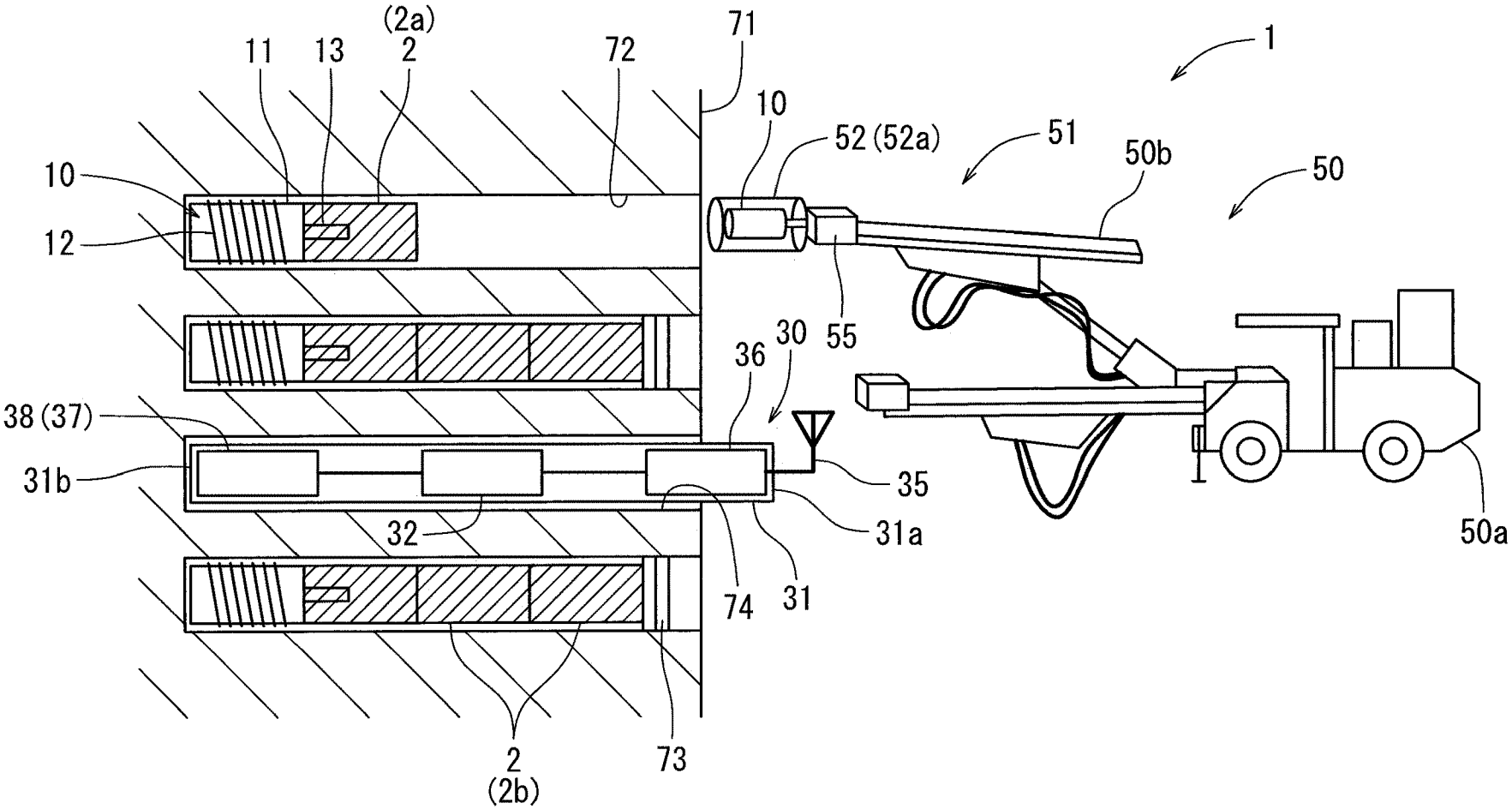
FIG. 2 is a cross-sectional view showing a detonator loaded in a hole in a blasting face and a relay device, and a schematic diagram of a detonator loading unit.

Preferred embodiments of the present disclosure are described in detail below with reference to the figures. The same reference numbers in the description denote similar elements with similar functions, so as to avoid redundant description. An embodiment of the present disclosure will be described with reference to FIGS. 1 to 9. A wireless detonation system 1 is used to detonate explosives to excavate or demolish structures, such as tunnels, sea floors, rocks, buildings, etc. In the present embodiment, as shown in FIG. 1, an excavation site of a tunnel 70 will be described as an example. The tunnel 70 has a blasting surface 71 at its inner end. A plurality of blast holes 72 are drilled in the blasting surface 71 at desired intervals in the vertical and horizontal directions. The blast hole 72 extends in the depth direction of the tunnel 70. As shown in FIG. 2, each blast hole 72 is loaded with a detonator 10 and a plurality of explosives 2. The entrance of the blast hole 72 in front of the explosive 2 is sealed with a sealing member 73, such as clay.

As shown in FIG. 1, the blasting surface 71 is drilled with one or more insertion holes 74 for disposing the relay device 30. The insertion holes 74 are positioned at desired intervals in the vertical and horizontal directions with respect to the plurality of blast holes 72, into which the explosives 2 are loaded. The insertion hole 74 extends in the depth direction of the tunnel 70 and is substantially parallel to the plurality of blast holes 72. The relay device 30 is inserted into the insertion hole 74. A portion of a housing 31 of the relay device 30 protrudes from the entrance of the insertion hole 74. The relay device 30 wirelessly communicates with each of the multiple detonators 10 in the various blast holes 72.

As shown in FIG. 1, the wireless detonation system 1 has a blasting operation device 40 disposed on the floor of the tunnel 70 or outside the tunnel 70. The blasting operation device 40 is disposed at a position away from the blasting face 71 by a distance L1. The distance L1 is set to, for example, 100 m to 1000 m. The blasting operation device 40 has a transmitting-receiving antenna 47 capable of communicating with the relay device 30 in a wireless manner. Therefore, the blasting operation device 40 can wirelessly communicate with each of the plurality of detonators 10 in the blast holes 72 via the relay device 30.

As shown in FIG. 2, the detonator 10 and the explosive 2 are loaded into each blast hole 72 using a detonator loading unit 51. The detonator loading unit 51 is provided, for example, to a vehicle-type explosive delivery unit 50. A power supply device 52 for charging the detonator 10 is attached to the detonator loading unit 51. The power supply device 52 supplies power to the detonator 10 immediately before the detonator 10 is loaded into the blast hole 72.

Alternatively, the power supply device 52 may be provided separately from the detonator loading unit 51 and may be of a portable type.

Now, the detonator 10 will be described in detail with reference to FIGS. 4 and 5. The detonator 10 has a detonator body 11 which is in substantially cylindrical in shape. A receiving coil 12 is annularly wound around the approximate center of the outer peripheral surface of the detonator body 11. The number of turns of the receiving coil 12 is one turn or more, for example, 10 turns or more. The receiving coil 12 generates a current with a specific frequency and amplitude when exposed to an electromagnetic field. The current is used as an electric power source for controlling and detonating the detonator 10. The receiving coil 12 also serves as a transmitting-receiving antenna for transmitting/receiving various signals of a specific frequency. The receiving coil 12 transmits specific signals when a current with a specific frequency and amplitude flows. The receiving coil 12 receives various signals of a specific frequency and amplitude when exposed to a specific electromagnetic field. The frequency of the electromagnetic waves is within the range of, for example, 1 kHz to 500 kHz, and preferably more than 10 kHz, e.g., 200 kHz, so as to have good permeability through soil or rock.

Figure 4:
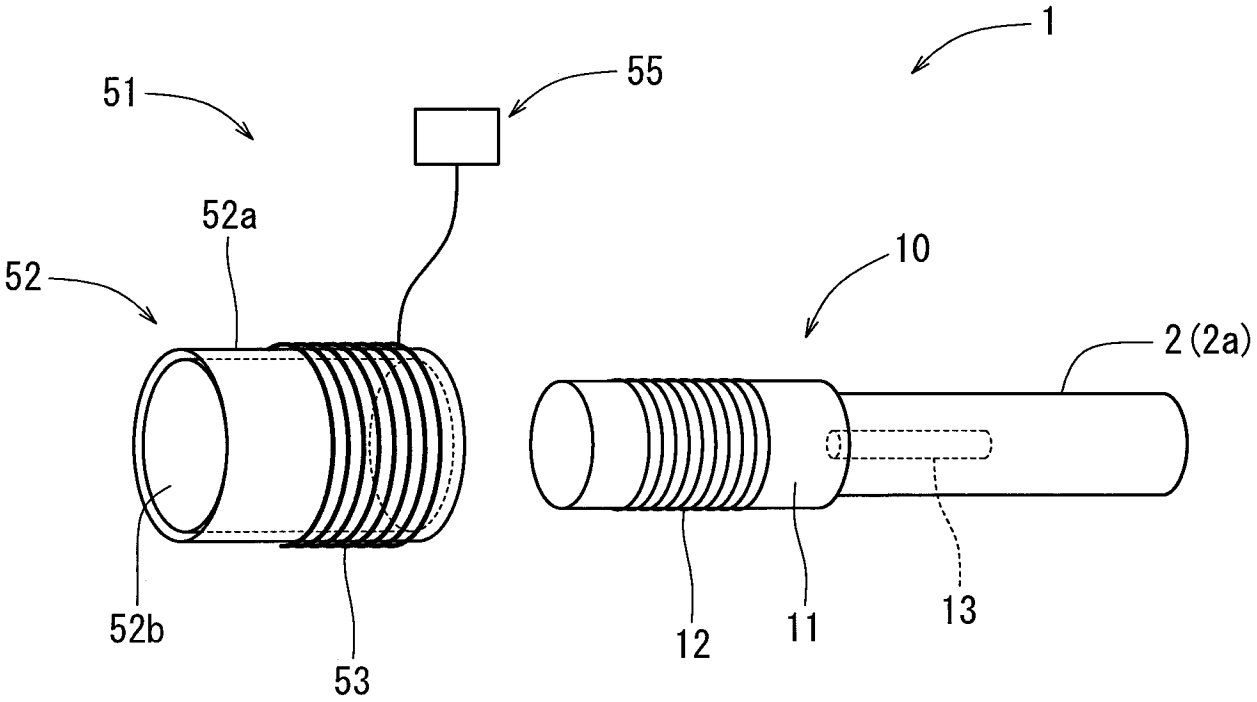
FIG. 4 is a schematic diagram of the detonator and a power-supplying coil of the detonator loading unit.

As shown in FIG. 4, the detonator 10 has a detonator ignition part 13 protruding from one end surface of the detonator body 11. The detonator ignition part 13 extends along the longitudinal direction of the detonator body 11. The detonator ignition part 13 is inserted into a parent die 2*a*, which is positioned in one of the explosives 2.

Figure 5:
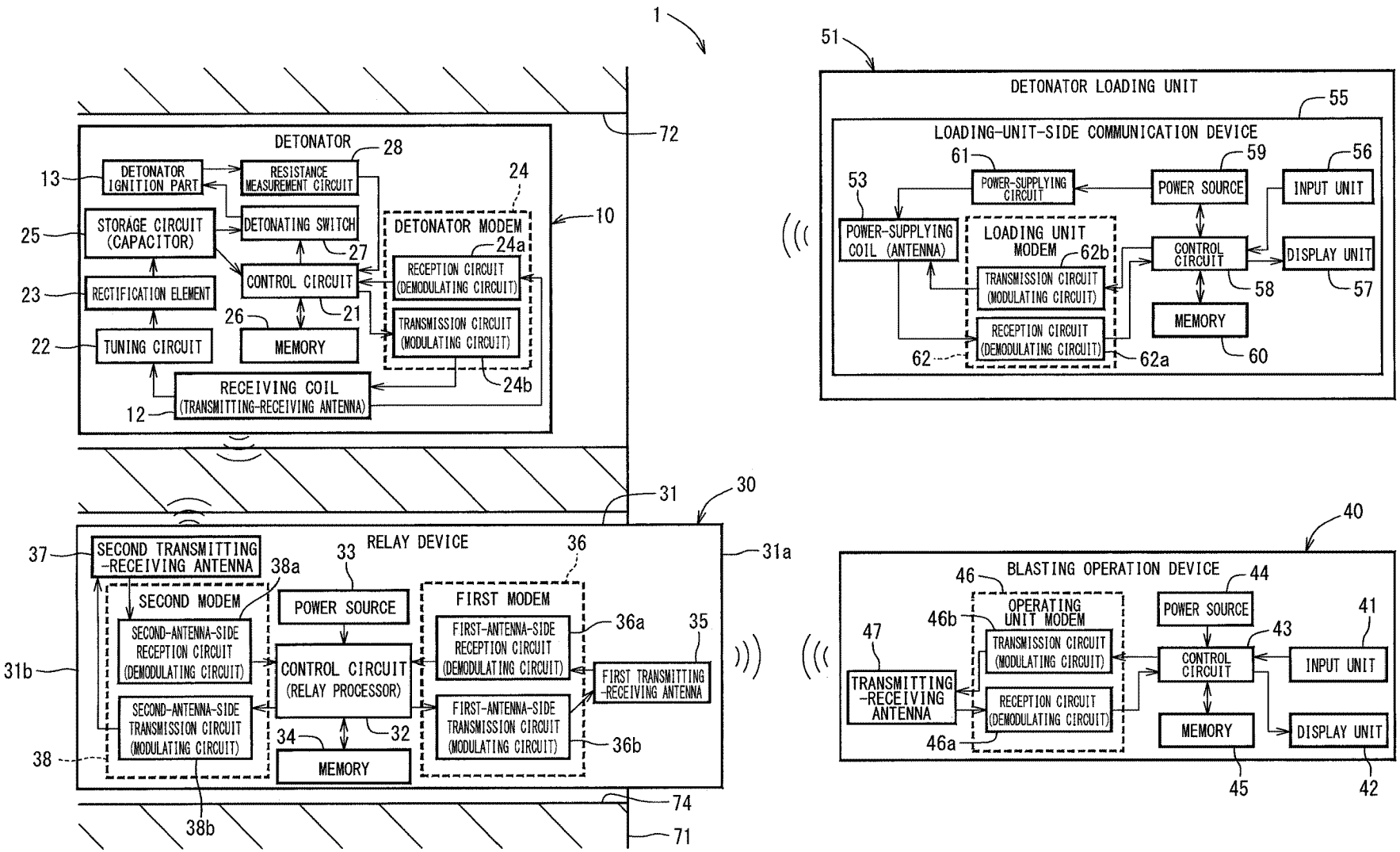
FIG. 5 is a block diagram of the wireless detonation system.
Figure 6:
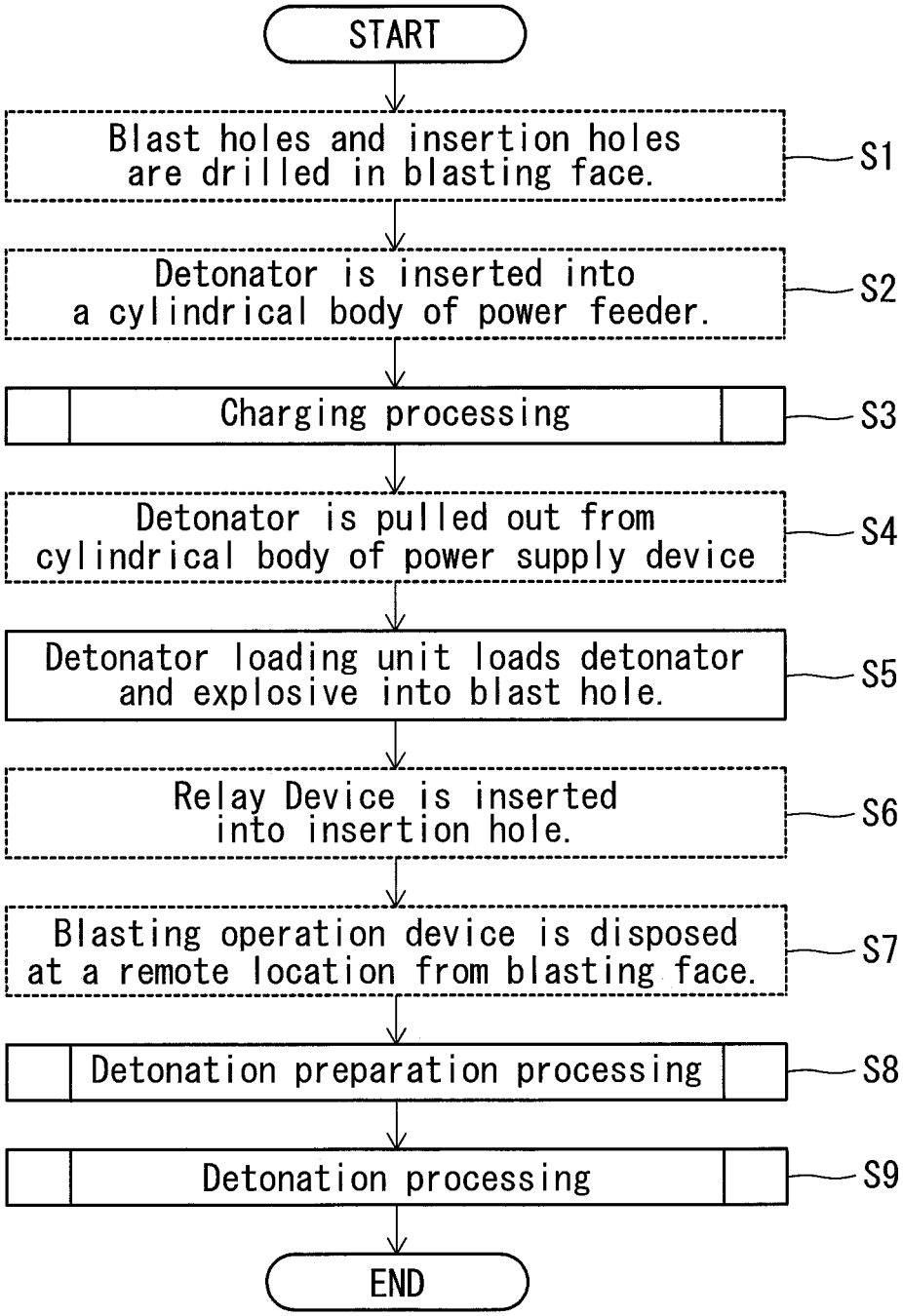
FIG. 6 is a flowchart showing a series of operations performed by the wireless detonation system.

As shown in FIG. 5, the detonator 10 has a tuning circuit 22, which is electrically connected to the receiving coil 12, a rectification element 23, and a storage circuit 25. The tuning circuit 22 tunes to the receiving frequency of the electric current generated when the receiving coil 12 receives electric power. The rectification element 23 rectifies the electric current input from the tuning circuit 22 to direct current. The storage circuit may be, for example, a capacitor and stores the power rectified by the rectification element 23. The storage circuit 25 stores the electric power to operate electronic components of the detonator 10 and the electric power used for igniting the detonator ignition part 13.

As shown in FIG. 5, the detonator 10 has a detonator modem 24, which uses the receiving coil 12 as an antenna. The detonator modem 24 has a reception circuit (a demodulation circuit) 24*a* and a transmission circuit (a modulation circuit) 24*b*. The reception circuit 24*a* and the transmission circuit 24*b* are connected to both the receiving coil 12 and a control circuit (CPU) 21. When the receiving coil 12 receives a signal, a current is generated. The reception circuit 24*a* converts (demodulates) the analog signal into a digital signal based on the change in current. The transmission circuit 24*b* converts (modulates) a digital signal transmitted from the control circuit 21 into an analog signal. A current based on the signal modulated by the transmission circuit 24*b* flows through the receiving coil 12. The detonator 10 has a memory 26 connected to the control circuit 21. An ID number (a serial number) unique to the detonator 10 and an algorithm are recorded in advance in the memory 26. The memory 26 records an initiation delay time based on a signal for setting the initiation delay time, which may be demodulated by the reception circuit 24*a*, for example.

As shown in FIG. 5, the detonator 10 has a detonating switch 27 and a resistance measurement circuit 28, both of which are connected to the control circuit 21. The detonating switch 27 switches the storage circuit 25 and the detonator ignition part 13 between the electrically connected and electrically disconnected states. The detonating switch 27 maintains the storage circuit 25 and the detonator ignition part 13 in a shutdown state when no ON signal is output from the control circuit 21. The detonating switch 27 puts the storage circuit 25 and the detonator ignition part 13 in a connected state when an ON signal is output from the control circuit 21. The resistance measurement circuit 28 measures the electrical resistance of the detonator ignition part 13 based on the output from the control circuit 21. This may be done in order to determine whether the detonator ignition part 13 is functioning normally.

As shown in FIG. 5, the relay device 30 has a housing 31 with a cylindrical shape. The housing 31 has a front end 31*a* at one end and a rear end 31*b* at the other end. The front end 31*a* is disposed at a position protruding from the entrance of the insertion hole 74. The rear end 31*b* is disposed at a far end of the insertion hole 74, which is positioned far from the entrance of the insertion hole 74. The relay device 30 has a first transmitting-receiving antenna 35 at its front end 31*a*. The relay device 30 has a second transmitting-receiving antenna 37 at its rear end 31*b*.

As shown in FIG. 5, the relay device 30 has a control circuit (CPU) 32. The control circuit 32 includes a relay processor. The relay processor receives and processes an input signal. The relay processor then processes and transmits a signal with a different frequency. For example, the relay processor may receive signals within the 1 MHz to 10 GHz range and may transmit signals at a frequency within the range of 1 kHz to 500 kHz. Alternatively, the relay processor may receive a signal within a frequency range of, for example, 1 kHz to 500 kHz, and may transmit a signal within a frequency range of 1 MHz to 10 GHz. The relay device 30 includes a power source 33 that supplies power to the control circuit 32 and a memory 34. The control circuit 32 is configured to record information in the memory 34 based on commands, read out data stored in the memory 34, and/or perform calculations based on algorithms stored in the memory 34.

As shown in FIG. 5, the relay device 30 has a first modem 36 and a second modem 38. The first modem 36 has a first-antenna-side reception circuit 36*a* and a first-antenna-side transmission circuit 36*b*. The first-antenna-side reception circuit 36*a* and the first-antenna-side transmission circuit 36*b* are connected to both the first transmitting-receiving antenna 35 and the control circuit 32. The first-antenna-side reception circuit 36*a* demodulates an analog signal received by the first transmitting-receiving antenna 35 into a digital signal. The first-antenna-side transmission circuit 36*b* modulates a digital signal transmitted from the control circuit 32 into an analog signal. The first transmitting-receiving antenna 35 transmits and/or receives radio waves in the frequency range of, for example, 1 MHz to 10 GHz. It is difficult for these frequencies to pass through soil and bedrock. The first transmitting-receiving antenna 35 preferably transmits and/or receives radio waves in the frequency range of 100 MHz or higher, for example, 920 MHz As shown in FIG. 5, the second modem 38 has a second-antenna-side reception circuit 38*a* and a second-antenna-side transmission circuit 38*b*. The second-antenna-side reception circuit 38*a* and the second-antenna-side transmission circuit 38*b* are connected to both the second transmitting-receiving antenna 37 and the control circuit 32. The second-antenna-side reception circuit 38*a* demodulates an analog signal received by the second transmitting-receiving antenna 37 into a digital signal. The first-antenna-side transmission circuit 36*b* modulates a digital signal transmitted from the control circuit 32 into an analog signal. The second transmitting-receiving antenna 37 transmits and/or receives radio waves in the frequency range of, for example, 1 kHz to 500 kHz. The second transmitting-receiving antenna 37 preferably transmits and/or receives radio waves with a frequency of approximately 200 kHz, which has good penetration through soil and bedrock.

As shown in FIG. 5, the blasting operation device 40 has a control circuit (CPU) 43, an input unit 41, and a display unit 42. The control circuit 43 outputs an electric signal to each electric part based on the electric signal input from each electric part of the blasting operation device 40. The input unit 41 includes, for example, a keyboard, switches, and a touch panel. The display unit 42 includes, for example, a display and a lamp that turns on and off. An operator operates the input unit 41 while confirming the information displayed on the display unit 42. The input unit 41 and the display unit 42 are electrically connected to the control circuit 43. The blasting operation device 40 has a power source 44 that supplies power to the control circuit 43 and has a memory 45. The control circuit 43 records information, such as the ID number of the detonator 10, in the memory 45 based on the commands, reads out data stored in the memory 45, and/or performs calculations based on algorithms stored in the memory 45.

As shown in FIG. 5, the blasting operation device 40 has the transmitting-receiving antenna 47 and an operating unit modem 46. The operating unit modem 46 has a reception circuit 46*a* and a transmission circuit 46*b*. The reception circuit 46*a* and the transmission circuit 46*b* are connected to both the transmitting-receiving antenna 47 and the control circuit 43. The reception circuit 46*a* demodulates an analog signal received by the transmitting-receiving antenna 47 into a digital signal. The transmission circuit 46*b* modulates a digital signal transmitted from the control circuit 43 into an analog signal. The transmitting-receiving antenna 47 transmits and/or receives radio waves in the frequency range of 1 MHz to 10 GHz, for example.

As shown in FIG. 2, the wireless detonation system 1 has an explosive delivery unit 50 that delivers the detonator 10 and the explosive 2 into each blast hole 72. The explosive delivery unit 50 has a boom 50*b* mounted on a vehicle 50*a*. The boom 50*b* is extendably and/or tiltably supported by the vehicle 50*a*. The detonator loading unit 51 is provided at the end of the boom 50*b*. The detonator loading unit 51 is moved into the blast hole 72 by extension/retraction and/or tilting of the boom 50*b*. The detonator loading unit 51 holds and then releases the detonator 10. The detonator 10 is loaded into the blast hole 72 by moving the detonator loading unit 51 into the blast hole 72.

As shown in FIG. 4, the detonator loading unit 51 has a power feeder 52 that feeds energy for driving to the receiving coil 12 of the detonator 10. The detonator 10 may be energized before it is charged into the blast hole 72. The power feeder 52 has a cylindrical body 52*a* that has a tubular-shape open on each side. The cylindrical body 52*a* has a power-supplying coil (an antenna) 53 wound in an annular shape. The power-supplying coil 53 is wound along the outer peripheral surface of the cylindrical body 52*a*. The number of turns of the power-supplying coil 53 is one turn or more, for example, 10 turns or more. The opening 52*b* of the cylindrical body 52*a* has an inner diameter larger than the outer diameter of the receiving coil 12, which is wound around the outer peripheral surface of the detonator body 11.

As shown in FIG. 4, the power-supplying coil 53 generates an electric field or magnetic field around the power-supplying coil 53 when a current with a specific frequency, amplitude, and wavelength flows. The power-supplying coil 53 may transmit a specific electromagnetic wave. The power-supplying coil 53 receives various signals having specific frequencies and amplitudes by being exposed to the specific electromagnetic fields. The power-supplying coil 53 communicates with the receiving coil 12 at a frequency within a frequency range of, for example, 1 kHz to 500 kHz, preferably at 200 kHz.

As shown in FIG. 5, the detonator loading unit 51 has a loading-unit-side communication device 55, which is capable of communicating with the receiving coil 12 of the detonator 10 before the detonator 10 is loaded into the blast hole 72. The loading-unit-side communication device 55 has a control circuit (CPU) 58, an input unit 56, and a display unit 57. The control circuit 58 outputs an electric signal to each electric component based on the electric signals input from each electric component of the loading-unit-side communication device 55. The input unit 56 includes, for example, a keyboard, switches, and a touch panel. The display unit 57 includes, for example, a display and a lamp that can be turned on and off. The operator operates the input unit 56 while confirming the information displayed on the display unit 57. The input unit 56 and the display unit 57 are electrically connected to the control circuit 58.

As shown in FIG. 5, the loading-unit-side communication device 55 has a power source 59 that supplies power to the control circuit 58, a memory 60, and a power-supplying circuit 61. For example, the control circuit 58 records information, such as the ID number of the detonator 10, in the memory 60, and/or reads data stored in the memory 60, and/or performs calculations based on algorithms stored in the memory 60 based on commands. The power-supplying circuit 61 is electrically connected to the power source 59 and the power-supplying coil 53. The control circuit 58 outputs a current from the power supply 59 to the power-supplying coil 53 via the power-supplying circuit 61. This is done based on a command.

As shown in FIG. 5, the loading-unit-side communication device 55 has a loading unit modem 62 connected to the power-supplying coil 53 and the control circuit 58. The loading unit modem 62 has a reception circuit 62*a* and a transmission circuit 62*b*. The reception circuit 62*a* and the transmission circuit 62*b* are connected to the power-supplying coil 53 and the control circuit 58, respectively. The reception circuit 62*a* demodulates the analog signal received by power-supplying coil 53 into a digital signal. The transmission circuit 62*b* modulates the digital signal transmitted from the control circuit 58 into an analog signal. The transmission circuit 62*b* outputs to the power-supplying coil 53 a current having a specific code signal and a specific frequency of 1 kHz to 500 kHz related to, for example, a signal for setting the initiation delay time.

The flow of the wireless detonation method for blasting and excavating the blasting face 71 using the wireless detonation system 1 will be described according to FIGS. 6 to 9. As shown in FIG. 1, an operator first drills a plurality of blast holes 72 and one or more insertion hole 74 into the blasting face 71 (Step S1 in FIG. 6). This is done in preparation for blasting. The blast hole 72 and the insertion hole 74 are drilled to have a diameter of about 5 cm and a depth of about 2 m, for example. As shown in FIG. 4, the detonator body 11 of the detonator 10 is inserted into the cylindrical body 52*a* of the power feeder 52 along the longitudinal direction (Step S2). The receiving coil 12 is moved to be disposed radially inward of the power power-supplying coil 53. The operator then operates the input unit 56 (see FIG. 5) to start electrically charging the detonator 10 (Step S3).

Figure 7:
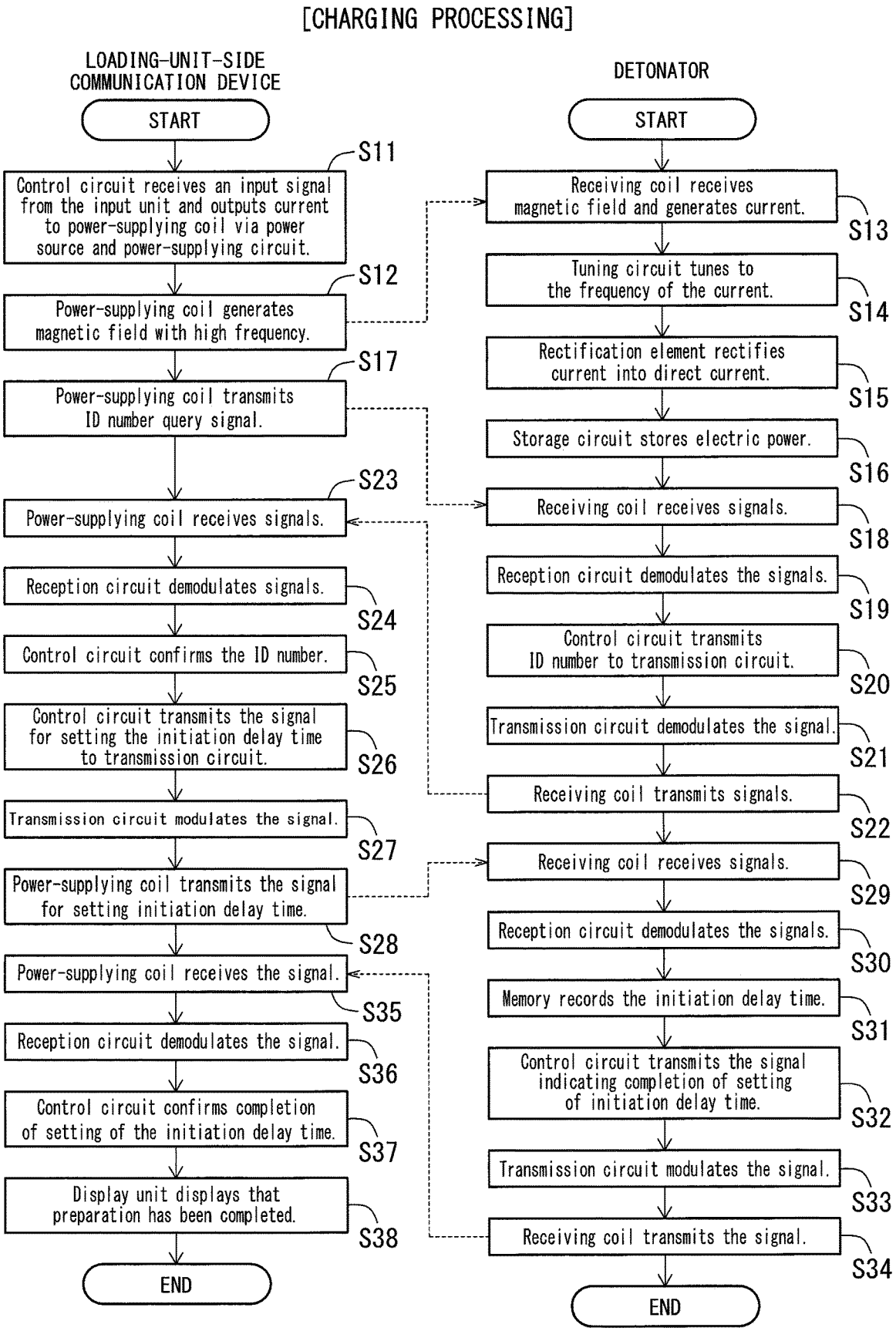
FIG. 7 is a flowchart of charging processing of the detonator in the wireless detonation system.

As shown in FIG. 5, the control circuit 58 of the loading-unit-side communication device 55 receives an input signal from the input unit 56 and outputs a current to the power-supplying coil 53 via the power-supplying circuit 61 (Step S11 in FIG. 7). The power-supplying coil 53 generates a magnetic field with a frequency within the range of, for example, 1 kHz to 500 kHz (Step S12). The receiving coil 12 of the detonator 10 receives the magnetic field and generates a current (Step S13). The tuning circuit 22 tunes to the frequency of the current generated by the receiving coil 12 (Step S14). The rectification element 23 rectifies the received current into a direct current (Step S15).

As shown in FIG. 5, the storage circuit 25 stores electric power due to being supplied with the direct current (Step S16). Note that the voltage of the storage circuit 25 is 0 V before the current is generated in the receiving coil 12. If the voltage of the storage circuit 25 is less than a predetermined value, no response will be made to a transmission of an ID number inquiry signal from the loading-unit-side communication device 55 (Step S17). If the storage circuit 25 responds, an amount of electric power to be used for controlling the detonator 10 and for igniting the detonator ignition part 13 will have been sufficiently accumulated in the storage circuit 25. When the receiving coil 12 receives an ID number inquiry signal (Step S18), the reception circuit 24*a* demodulates the inquiry signal (Step S19). The control circuit 21 then transmits the ID number of detonator 10 to the transmission circuit 24*b* (Step S20). The transmission circuit 24*b* modulates the signal (Step S21), and then transmits it to the receiving coil 12. The receiving coil 12 transmits the modulated signal using a radio wave within the range of, for example, 1 kHz to 500 kHz (Step S22).

As shown in FIG. 5, the power-supplying coil 53 is configured to receive a signal (Step S23). The reception circuit 62*a* demodulates this signal (Step S24), and then transmits it to the control circuit 58. The control circuit 58 checks the ID number of the detonator 10 (Step S25), and then records the ID number in the memory 60. The control circuit 58 transmits the signal for setting the initiation delay time, which may correspond to the ID number of the detonator 10, to the transmission circuit 62*b* (Step S26). The transmission circuit 62*b* modulates the signal (Step S27), and then the power-supplying coil 53 generates a magnetic field with a frequency within the range of, for example, 1 kHz to 500 kHz. The transmission circuit 62*b* also transmits a signal for setting the initiation delay time (Step S28).

As shown in FIG. 5, the receiving coil 12 receives a signal (Step S29), which the reception circuit 24*a* then demodulates (Step S30). The memory 26 records the initiation delay time based on a command from the control circuit 21 (Step S31). The control circuit 21 then transmits a signal indicating completion of the setting of the initiation delay time to the transmission circuit 24*b* (Step S32). The transmission circuit 24*b* modulates the signal (Step S33), and then transmits it to the receiving coil 12. The receiving coil 12 transmits the modulated signal using radio waves within the range of, for example, 1 kHz to 500 kHz (Step S34).

As shown in FIG. 5, the power-supplying coil 53 receives a signal (Step S35), which the reception circuit 62*a* then demodulates (Step S36). The demodulated signal is then transmitted to the control circuit 58. The control circuit 58 confirms completion of the setting of the initiation delay time of the detonator 10 (Step S37). The display unit 57 displays that the charging processing (preparation) for the detonator 10 has been completed (Step S38).

As shown in FIG. 2, the power supply device 52 is provided at the end of the boom 50*b* of the detonator loading unit 51. Alternatively, the power supply device 52 may be provided at a location different from the boom 50*b*. For example, the power supply device 52 may be provided separately from the detonator loading unit 51. In such a case, as shown in FIG. 4, the operator pulls out the fully charged detonator 10 from the cylindrical body 52*a* of the power supply device 52 (Step S4 in FIG. 6). The operator then sets the charged detonator 10 in the explosive delivery unit 50. As shown in FIG. 2, the detonator 10 and the explosive 2 are loaded into the blast hole 72 using the detonator loading unit 50 (Step S5). The detonator 10 is loaded with the parent die 2*a* facing forward. The parent die 2*a* is connected to the detonator ignition part 13. A plurality of additional dies 2*b* are loaded on the front side of each of the parent dies 2*a*. The entrance of the blast hole 72 is then sealed off with a sealing member 73. The operator inserts the relay device 30 into the insertion hole 74 (Step S6). The rear end 31*b*, which has the second transmitting-receiving antenna 37, is disposed in the end of the insertion hole 74, where is far from the entrance. The front end 31*a*, which has the first transmitting-receiving antenna 35, protrudes from the entrance of the insertion hole 74. The first transmitting-receiving antenna 35 is supported by the housing 31.

Figure 3:
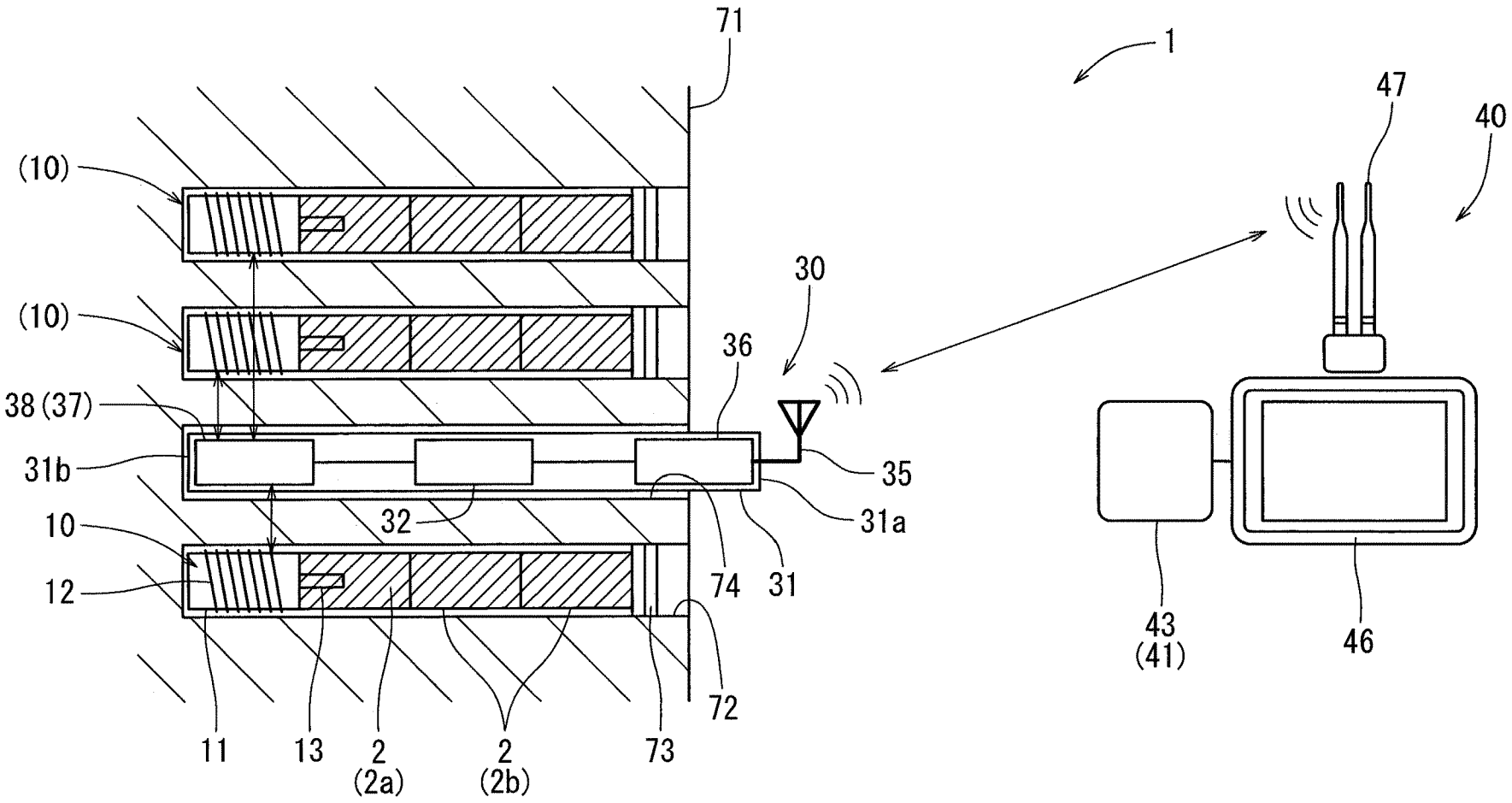
FIG. 3 is a schematic diagram of a detonator, a relay device, and a blasting operation device according to a first embodiment.

Referring to FIG. 3, an operator disposes the blasting operation device 40 at a remote location at a certain distance from the blasting face 71 (Step S7). This is done after all detonators 10, explosives 2, and relay devices 30 have been loaded. The explosive delivery unit 50, which has the detonator loading unit 51 (see FIG. 2), is evacuated to a remote location a certain distance from the blasting face 71. The operator operates the input unit 41 to start a blast preparation process of the detonators 10 (Step S8).

Figure 8:
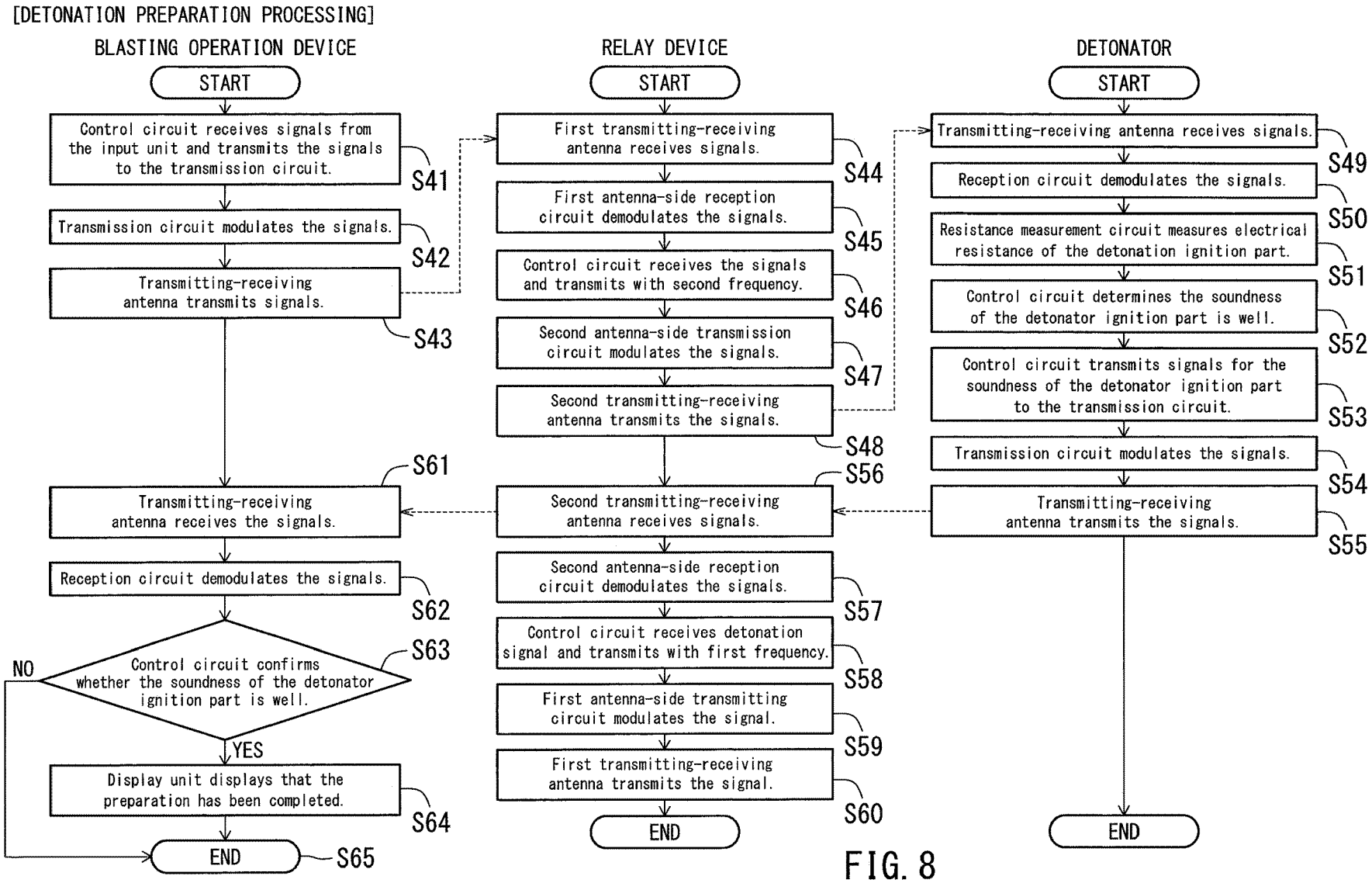
FIG. 8 is a flowchart of detonation preparation processing of the wireless detonation system.

Referring to FIG. 5, the control circuit 43 of the blasting operation device 40 receives signals from the input unit 41 and transmits signals for blast preparation, which may be used to confirm the soundness of the detonator ignition part 13, to the transmission circuit 46*b* (Step S41 in FIG. 8). The transmission circuit 46*b* converts the signals (Step S42) and the transmitting-receiving antenna 47 transmit downstream signals with radio waves in the range of, for example, 1 MHz to 10 GHz (Step S43).

Referring to FIG. 5, the first transmitting-receiving antenna 35 of the relay device receives downstream signals (Step S44) and the first antenna-side reception circuit 36 demodulates the signals (Step S45). A rely processor of the control circuit 32 processes the received high frequency signals having a frequency within the range of, for example, 1 MHz to 10 GHz (Step S46). A second antenna-side transmission circuit 38*b* modulates signals (Step S47) and a second transmitting-receiving antenna 37 transmits downstream signals with radio waves having a frequency within the range of, for example, 1 kHz to 500 kHz (Step S48).

Referring to FIG. 5, the receiving coil 12 receives downstream signals (Step S49) and the reception circuit 24*a* demodulates the signals (Step S50). A resistance measurement circuit 28 serves to measure the electrical resistance of the detonator ignition part 13 based on the output from the control circuit 21 (Step S51). The control circuit 21 determines the soundness (conductivity) of the detonator ignition part 13 from the measured resistance value (Step S52). The control circuit 21 transmits signals corresponding to the soundness of the detonator ignition part 13 to the transmission circuit 24*b* (Step S53). The transmission circuit 24 modulates the signals (Step S54) and the receiving coil 12 (e.g. transmitting-receiving antenna) transmits upstream signals using radio waves within the range of, for example, 1 kHz to 500 kHz (Step S55).

Referring to FIG. 5, the second transmitting-receiving antenna 37 receives upstream signals (Step S56) and the second antenna-side reception circuit 38*a* demodulates the signals (Step S57). The relay processor of the control circuit 32 processes the received low frequency signals having a frequency within the range of, for example, 1 kHz to 500 kHz, and processes to transmit high frequency signals having a frequency within the range of, for example, 1 MHz to 10 GHz (Step S58). The first antenna-side transmission circuit 36*b* modulates signals (Step S59) and the first transmitting-receiving antenna 35 transmits upstream signals with radio waves having a frequency within the range of, for example 1 MHz to 10 GHz (Step S60).

Referring to FIG. 5, the transmitting-receiving antenna 47 receives upstream signals (Step S61), and the reception circuit 46*a* modulates (e.g. demodulates) the signals (Step S62). When the soundness of the detonator ignition part 13 is determined to be sufficient by the control circuit 43 (Step S63), the control circuit 43 allows the display unit 42 to display that the blast preparation of the detonator 10 has been completed (Step S64). When the soundness of the detonator ignition part 13 of the detonator 10 with a certain ID number is determined to be insufficient (Step S63), the control circuit 43 allows the display unit 42 to display the ID number of the detonator 10 and the detonator ignition part 13 that has insufficient soundness. After the blast preparation process has been completed, the operator may operate the input unit 41 to start a blast process of the detonators 10 (Step S9 in FIG. 6).

Figure 9:
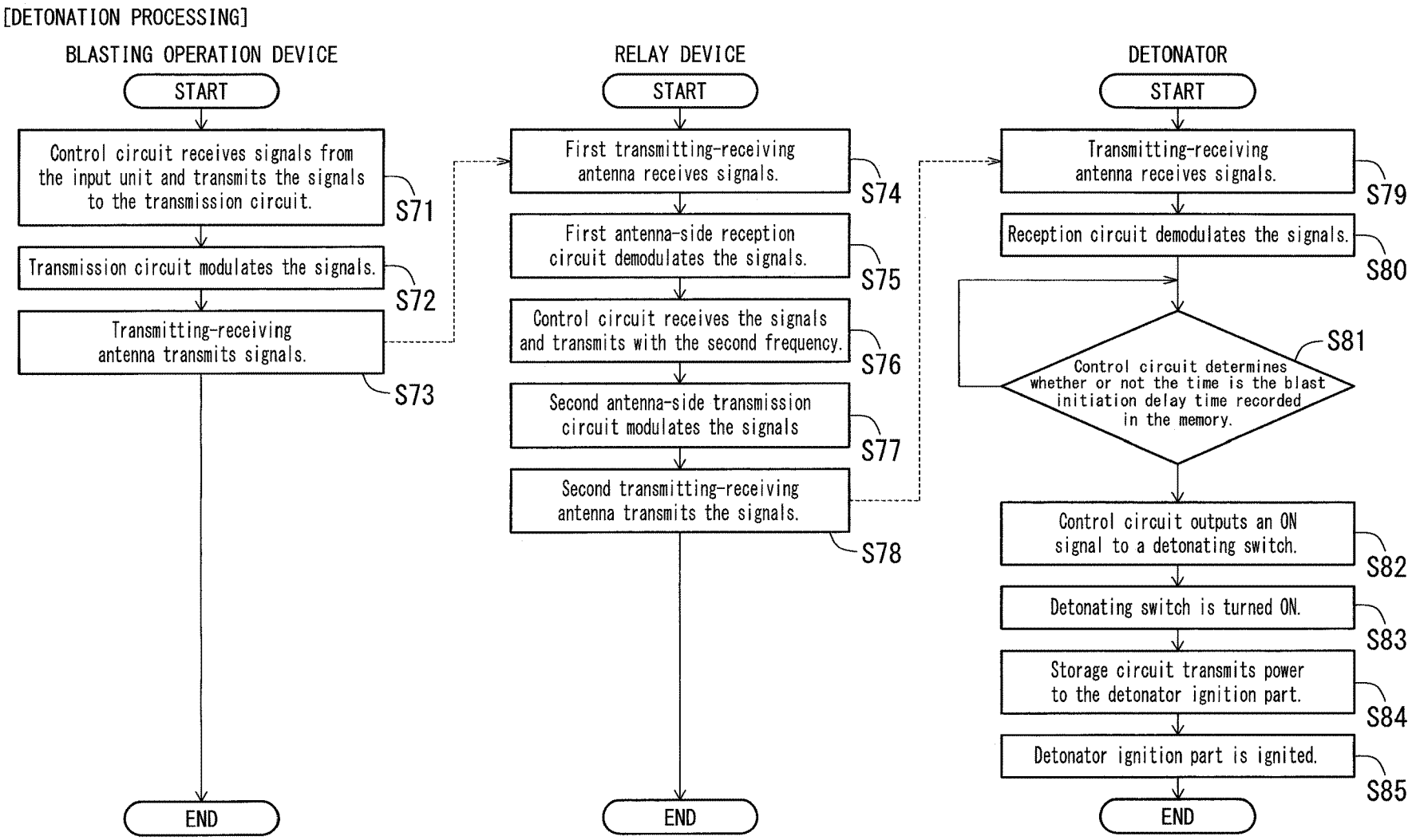
FIG. 9 is a flowchart of detonation processing of the wireless detonation system.

Referring to FIG. 5, when the operator operates the input unit 41 of the blasting operation device 40, the control circuit 43 receives signals from the input unit 41 and transmits detonation initiation signals to the transmission circuit 46*b* (Step S71 in FIG. 9). The transmission circuit 46*b* modulates the signals (Step S72) and the transmitting-receiving antenna 47 transmits the downstream signals with radio waves having a frequency within the range of, for example, 1 MHz to 10 GHz (Step S73). The first transmitting-receiving antenna 35 of the relay device 30 receives the downstream signals (Step S74) and the first antenna-side reception circuit 36*a* demodulates the signals (Step S75). The rely processor of the control circuit 32 processes to receive high frequency signals having a frequency within the range of, for example, 1 MHz to 10 GHz (Step S76). The second antenna-side transmission circuit 38*b* modulates signals (Step S77) and the second transmitting-receiving antenna 37 transmits downstream signals with radio waves having a frequency within the range of, for example, 1 kHz to 500 kHz (Step S78).

Referring to FIG. 5, the receiving coil 12 receives downstream signals (Step S79) and the reception circuit 24*a* demodulates the signals (Step S80). The control circuit 21 activates an internal timer upon receiving the detonation initiation signals. It is then determined whether or not the time counted by the timer has reached the blast initiation delay time recorded in the memory 26 (Step S81). This determination will be repeated until the count time of the timer reaches the blast initiation delay time. When the count time of the timer has reached the blast initiation delay time, the control circuit 21 outputs an ON signal to a detonating switch 27 (Step S82). The detonating switch 27 is turned ON and connected (Step S83), which allows the storage circuit 25 to transmit power to the detonator ignition part 13 via the detonating switch 27 (Step S84). The detonator ignition part 13 is then ignited (Step S85), such that the explosives 2 (see FIG. 3) are detonated.

According to the wireless detonation system 1 described-above, as shown in FIG. 5, the wireless detonation system 1 includes a blasting operation device 40, a detonator 10, and a relay device 30. The blasting operation device 40 is disposed at a distance from the blasting face 71 and is configured to wirelessly transmit a first downstream signal at a first frequency. The first detonator 10, which has been loaded in the blast hole 72 of the blasting face 71, includes a receiving coil 12 configured to wirelessly receive a second downstream signal at a second frequency lower than the first frequency. The relay device includes a first transmitting-receiving antenna 35 for receiving the first downstream signal. The relay device 30 further includes a relay processor for the control circuit 32 configured to be used to process the wirelessly received first downstream signal and to transmit the second downstream signal at the second frequency. The relay device 30 further includes a second transmitting-receiving antenna 37 configured to be used to wirelessly transmit the second downstream signal. The second transmitting-receiving antenna 37 is loaded in an insertion hole 74 of the blasting face 71, the insertion hole 74 being aligned with the blast hole 72.

Therefore, the relay device 30 and the detonator 10 are configured to communicate wirelessly with each other at the second frequency, which is relatively low frequency. For example, the relay device 30 and the detonator 10 communicate wirelessly at a low enough frequency that can penetrate a bedrock constituting a blasting target. Since the relay device 30 and the detonator 10 are placed in either the blast holes 72 or the insertion holes 71 formed in the blasting face 71, they can be positioned close to each other. Therefore, the relay device 30 and the detonator 10 can wirelessly communicate with each other using signals with a small power of, for example, less than or equal to 10 W. On the other hand, the relay device 30 and the blasting operation device communicate wirelessly using the first frequency, which is a relatively high frequency. Therefore, it is possible to prevent signals from leaking to the surroundings, such as outside the tunnel 70, of the blasting target.

As shown in FIG. 5, the detonator 10 includes a receiving coil 12 for wirelessly transmitting a second upstream signal at the second frequency. The relay device 30 includes the second transmitting-receiving antenna 37 for wirelessly receiving the second upstream signal. The relay device 30 further includes a relay processor of the control circuit 32. The relay processor is configured to process the wirelessly received second upstream signal and to wirelessly transmit using the first upstream signal at the first frequency. The relay device 30 also includes a first transmitting-receiving antenna 35 for wirelessly transmitting the first upstream signal. The blasting operation device 40 wirelessly receives the first upstream signal. Therefore, the above-mentioned effect can be wirelessly obtained not only with the downstream signal transmitted from the blasting operation device 40 to the detonator 10 via the relay device 30, but also with the upstream signal in the opposite direction.

As shown in FIG. 5, an explosive-side receiving antenna and an explosive-side transmitting antenna are a common receiving coil 12. A first receiving antenna and a first transmitting antenna are a common first transmitting-receiving antenna 35. A second receiving antenna and a second transmitting antenna are a common second transmitting-receiving antenna 37. Therefore, the number of parts of the entire wireless detonation system 1 can be reduced.

As shown in FIG. 5, the relay device 30 includes a housing which is partially or entirely inserted into the insertion hole 74. The first transmitting-receiving antenna 35, the second transmitting-receiving antenna 37, and the control circuit 32 having the relay processor are integrally provided in the housing 31. Therefore, the relay device 30 is supported by the blasting target via the housing 31. This allows the relay device 30 to be easily inserted into and supported by the blasting target.

As shown in FIG. 5, the housing 31 includes a rear end 31*b* disposed in the rear side of the insertion hole 74. The second transmitting-receiving antenna 37 is provided at the rear end. The first transmitting-receiving antenna 35 is provided at the front end of the housing 31 opposite to the rear end. Therefore, the second transmitting-receiving antenna 37 is positioned at the location close to the detonator 10, which is also loaded in the rear side of the blast hole 72. Therefore, the relay device 30 and the detonator 10 can communicate with each other using low power signals, for example, less than or equal to 10 W. On the other hand, the first transmitting-receiving antenna 35 is positioned at a location close to the opening of the insertion hole 74. Therefore, the first transmitting-receiving antenna 35 can wirelessly communicate with the blasting operation device 40 using signals that have not been interrupted by a bedrock constituting a blasting target.

As shown in FIG. 5, the front end 31*a* of the housing 31 is disposed with the first transmitting-receiving antenna 35 projecting from the insertion hole 74 and beyond the blasting face 71. Therefore, the relay device 30 and the blasting operation device 40 can wirelessly communicate with each other using signals that would normally be interrupted by the bedrock, etc. constituting the blasting target. Further, the first transmitting-receiving antenna 35 projects from the blasting face 71 using the housing 31 held by the blasting target. The first transmitting-receiving antenna 35 is thus supported by the blasting target using a simple structure.

As shown in FIG. 5, the second frequency is within a range of 1 kHz to 500 kHz, which typically penetrates bedrock. The first frequency is within the range of 1 MHz to GHz. Therefore, the relay device 30 and the detonator 10 can easily communicate with each other wirelessly within the bedrock. Further, the frequency bands at the first frequency and the second frequency are separated from each other. Thus, interference between signals at the first frequency and signals at the second frequency can be reduced, thereby preventing erroneous communication.

As shown in FIG. 2, a detonator loading unit 51 is provided to load the detonator into the blast hole 72. The detonator loading unit 51 includes a loading-unit-side communication device 55 capable of communicating with the receiving coil 12 of the detonator 10. This communication may occur before the detonator 10 is loaded into the blast hole 72 using radio signals at the second frequency. Therefore, a process to allow for communication between the detonator 10 and the loading-unit side communication device 55 and a process to load the detonator 10 into the blast hole 72 can be efficiently performed in a series of flows. Further, the same receiving coil 12 can be used for receiving signals from the loading-unit-side communication device 55 and for receiving signals from the relay device 30. It is thus possible to reduce the number of parts of the detonator 10.

As shown in FIG. 5, the detonator 10 includes a receiving coil 12 to receive energy for driving the circuit and includes a storage circuit 25 to store the energy used for driving the detonation. The detonator loading unit 51 includes a power supplying coil 53 that feeds energy for driving to the receiving coil 12 of the detonator 10 before it is charged into the blast hole 72. The storage circuit 25 can thus maintain a state in which the energy used for driving the detonation is not sufficiently accumulated within the detonator until immediately before the detonator 10 is loaded in the blast hole 72. Therefore, when transporting the detonator 10 to the blasting face 71, the detonator 10 can be transported in a low-energy, stable state. The power is supplied to the detonator 10 immediately before being loaded into the blast hole 72. It is thus possible to use, for example, a capacitor having a relatively small capacity in the storage circuit 25. As a result, the cost of the detonator 10 can be reduced. Since it is also possible to shorten the power supply time, the work can be done efficiently.

As shown in FIG. 2, the detonator loading unit 51 is provided to the explosive delivery unit 50, which is configured to deliver explosives to be loaded in the blast holes 72. Therefore, a process to load the detonators 10 into the blast holes 72 and a process to load the explosives on a further front side than the detonators 10, which have been loaded in the blast holes 72, can be efficiently performed in a series of flows.

As shown in FIG. 5, the relay device 30 includes a second transmitting-receiving antenna 37, a control circuit 32 having the relay processor, and a first transmitting-receiving antenna 35. The second transmitting-receiving antenna 37 wirelessly receives second upstream signals transmitted by the detonator 10 at the second frequency. The relay processor processes the wirelessly received second upstream signal and processes to wirelessly transmit the first upstream signal at the first frequency. The first transmitting-receiving antenna 35 wirelessly transmits the first upstream signal. The second transmitting-receiving antenna 37, the relay processor, and the first transmitting-receiving antenna 35 are attached to the housing 31. Therefore, the above-mentioned effect can be wirelessly obtained not only with the downstream signal transmitted from the blasting operation device 40 to the detonator 10 via the relay device 30, but also with the upstream signal in the opposite direction.

As shown in FIG. 1, the blasting operation device 40 is disposed at a position distanced from the blasting target. The relay device 30 is disposed within the insertion hole 74 of the blasting target. The blasting operation device 40 and the first transmitting-receiving antenna 35 of the rely device 30 wirelessly communicate with each other using signals at the first frequency within the range of, for example, 1 MHz to 10 GHz. The detonator 10 is disposed within the blast hole 72 of the blasting target. The detonator 10 and the second transmitting-receiving antenna 37 of the relay device 30 wirelessly communicate with each other using signals at the second frequency within the range of, for example, 1 kHz to 500 kHz. The relay processor of the relay device 30 processes the received first frequency signals and processes to transmit the second frequency signals. Further, the relay processor of the relay device 30 processes the received second frequency signals and processes to transmit the first frequency signals.

Therefore, the relay device 30 and the detonator 10 wirelessly communicate with each other using signals having a frequency within the range of, for example, 1 kHz to 500 kHz, which penetrates the bedrock, etc. constituting the blasting target. Since both the relay device 30 and the detonator 10 are disposed in either the blast hole 72 or the insertion hole 74, they are positioned in locations close to each other. Therefore, the relay device and the detonator 10 can wirelessly communicate with each other using low power signals of, for example, less than or equal to 10 W. On the other hand, the relay device 30 and the blasting operation device 40 wirelessly communicate using signals at a frequency having a relatively high frequency, for example within the range of 1 MHz to 10 GHz. Therefore, it is possible to prevent signals from leaking to the surroundings such as outside a tunnel 70, which is a blasting target.

As shown in FIG. 5, the blasting operation device 40 wirelessly transmits the first downstream signal at the first frequency to the relay device 30. The relay processor of the relay device 30 processes the wirelessly received first downstream signal and processes to wirelessly transmit the second downstream signal at the second frequency. The relay device 30 wirelessly transmits the second downstream signal to the detonator 10. Therefore, the downstream signal, which is wirelessly transmitted at the first frequency, is transmitted from the blasting operation device 40 to the relay device 30 while being prevented from leaking to the surroundings outside of the blasting target, such as outside the tunnel 70. The downstream signal, which is wirelessly transmitted at the second frequency, is transmitted from the relay device 30 to the detonator 10 by penetrating the bedrock, etc. constituting the blasting target. Therefore, the downstream signal can be favorably wirelessly transmitted from the blasting operation device 40 to the detonator 10 via the relay device 30.

Another embodiment of the present disclosure will be described with reference to FIGS. 10 and 11. The wireless detonation system 80 according to the second embodiment includes a relay device 81 shown in FIG. 10, instead of the relay device 30 of the wireless detonation system 1 shown in FIG. 5. The relay device 81 includes a receiving coil 85 wound annularly around an outer circumferential surface of the substantially cylindrical housing 82, instead of the second transmitting-receiving antenna 37 (see FIG. 5). The number of turns of the receiving coil 85 is more than or equal to one turn, for example, more than or equal to 10 turns. When the receiving coil 85 is exposed to an electromagnetic field to generate electric current, the electric current can be used as electric power for driving the relay device 81. The receiving coil 85 also serves as the second transmitting-receiving antenna for wirelessly transmitting and receiving signals within a frequency range of, for example, 1 kHz to 500 kHz.

Figure 10:
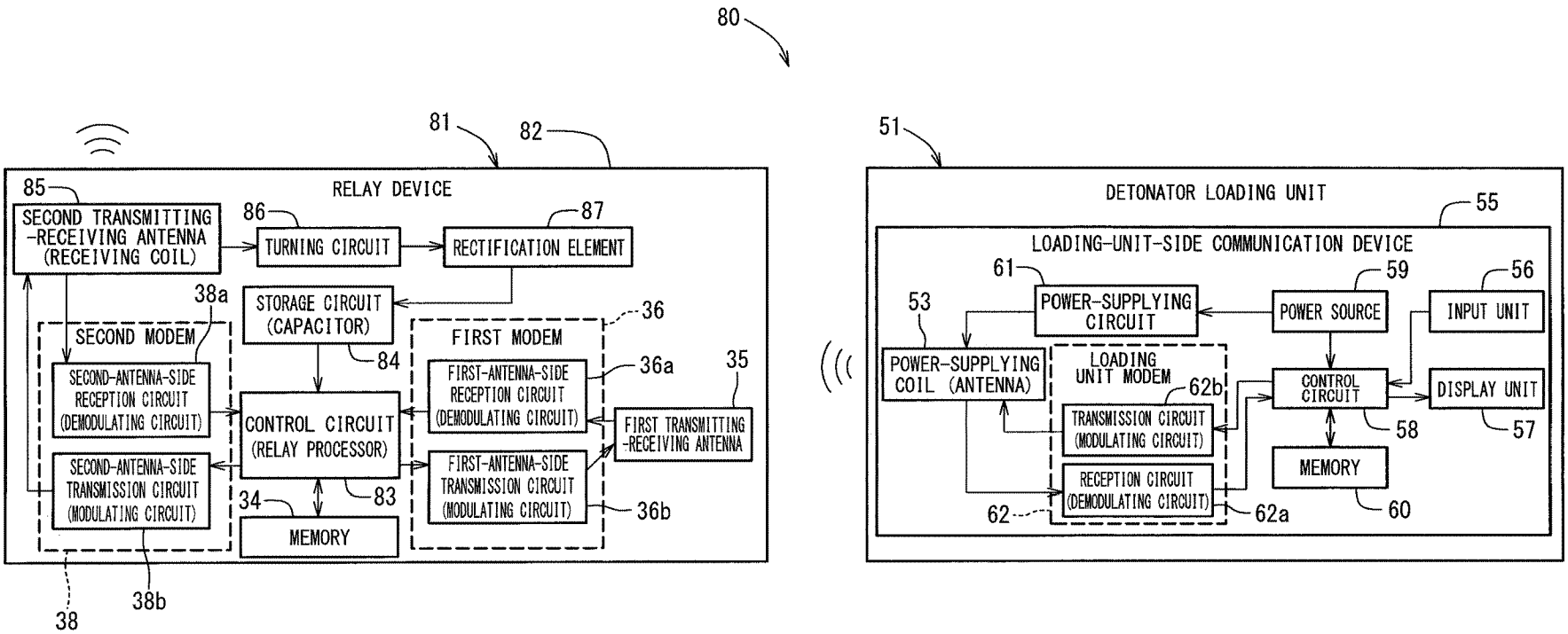
FIG. 10 is a block diagram of a relay device and a detonator loading unit according to a second embodiment.
Figure 11:
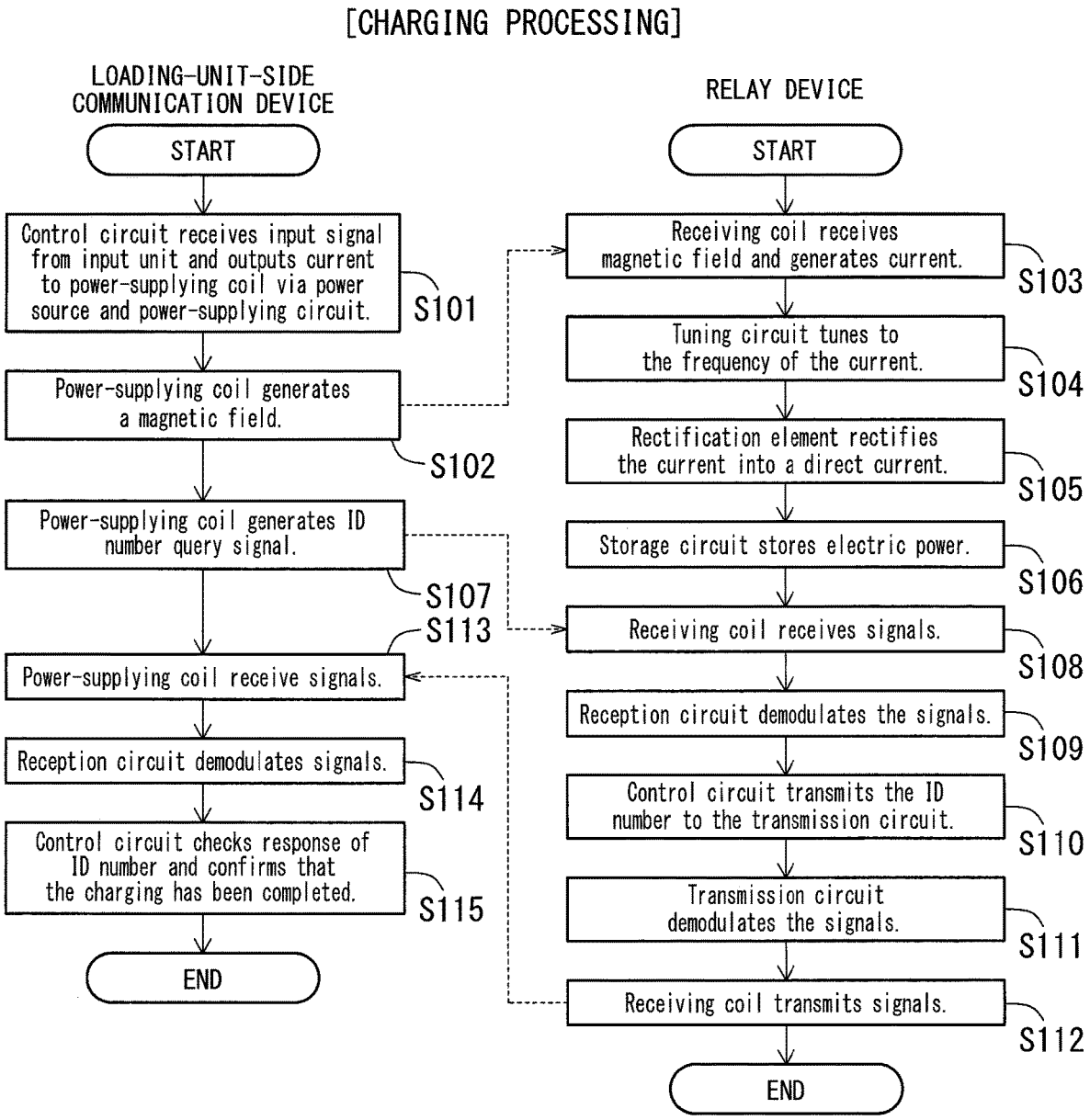
FIG. 11 is a flowchart of charging processing of the relay device of FIG. 10.

As shown in FIG. 10, the relay device 81 includes a tuning circuit 86, a rectification element 87, and a storage circuit 84 electrically connected to the receiving coil 85, instead of the power source 33 (see FIG. 5). The tuning circuit 86 tunes to the receiving frequency of the electric current generated when the receiving coil 85 receives electric power. The rectification element 87 serves to rectify the electric current input from the tuning circuit 86 to direct current. The storage circuit 84 may be, for example, a capacitor. The storage circuit 84 stores the electric power rectified by the rectification element 87, which can then be used as the electric power to operate each electronic component of the relay device 81.

The flow of processes to charge the storage circuit 84 of the relay device 81 will be described according to FIG. 11. The charging processes of the relay device 81 can be performed between Step S5 and Step S6 shown in FIG. 6. First, referring to FIG. 10, the control circuit 58 of the loading-unit-side communication device 55 receives input signals from the input unit 56 and outputs electric current to the power-supplying coil 53 via the power-supplying circuit 61 (Step S101 in FIG. 11). The power-supplying coil 53 generates a magnetic field with a frequency within the range of, for example, 1 kHz to 500 kHz (Step S102). The receiving coil 85 of the relay device 81 receives the magnetic field and generates electric current (Step S103). The tuning circuit 86 tunes to the frequency of the electric current generated by the receiving coil 85 (Step S104). The rectification element 87 rectifies the received electric current into a direct current (Step S105).

As shown in FIG. 10, the storage circuit 84 stores electric power by being supplied with direct current (Step S106). If the voltage of the storage circuit 84 is less than a predetermined value, no response is made to the transmission of the ID number inquiry signal from the loading-unit-side communication device 55 (Step S107). If it responds, the electric power for driving the rely device 81 has sufficiently accumulated within the storage circuit 84. Accordingly, the receiving coil 85 receives the ID number inquiry signal (Step S108), and then the second antenna-side reception circuit 38*a* demodulates the signal (Step S109). The control circuit 83 transmits the ID number of storage circuit 84 to the second antenna-side transmission circuit 38*b* (Step S110). The second antenna-side transmission circuit 38*b* modulates the signal (Step S111), and then the receiving coil 85 transmits the modulated signal by radio waves within the range of, for example, 1 kHz to 500 kHz (Step S112).

As shown in FIG. 10, the power-supplying coil 53 receives the signals (Step S113). The reception circuit 62*a* demodulates the signals (Step S114), then transmits them to the control circuit 58. The control circuit 58 checks the response of the ID number of the relay device 81 (Step S115) and confirms that charging has been completed (Step S115). The control circuit 58 also allows the display unit 57 to display that the charging processing of the relay device 81 has been completed.

According to the above-described wireless detonation system 80, as shown in FIG. 10, the relay device 81 includes a receiving coil 85 for receiving energy for driving from the power supplying coil 53 of the detonator loading unit 51. The relay device 81 also includes a storage circuit 84 for storing the energy for driving. Therefore, electric power can be supplied to the relay device 81 using the power supplying coil 53, which also feeds the electric power to the detonator 10 (see FIG. 5). It is thus possible to reduce the number of parts of the entire wireless detonation system 80. Further, the electric power is stored in a storage circuit 84 immediately before inserting the relay device 81 into the insertion hole 74. The storage capacity of the storage circuit 84 can thus be reduced to the minimum amount required for communication.

As shown in FIG. 10, the detonator loading unit 51 wirelessly feeds electric power to the detonator 10 (see FIG. 1) and to the relay device 81 while they are in the vicinity of the blasting target. The detonator loading unit 51 loads the electrically charged detonator into the blast hole 72 (see FIG. 1) of the blasting target. The detonator loading unit 51 loads the electrically charged relay device 81 into the insertion hole 74 (see FIG. 1) of the blasting target. Therefore, a process for loading the detonators 10 into the blast holes 72 and/or a process for charging the relay device 81 and then loading it into the insertion hole 74 can be efficiently performed in the vicinity of the blasting face 71 in a series of flows. The power is supplied to the detonator 10 immediately before it is loaded into the blast hole 72 or to the relay device 81 immediately before being loaded into the insertion hole 74. It is thus possible to use a capacitor having a relatively small capacity as part of the storage circuits 25, 81. As a result, the cost of the detonator 10 and the relay device 81 can be reduced.

As shown in FIG. 2, the power supply device 52 is provided at the detonator loading unit 51. In this case, the detonator 10 is delivered to the detonator loading unit 51 using the explosive delivery unit 50. The detonator 10 is inserted into the cylindrical body 52*a* through an entrance of the cylindrical body 52*a* of the power supply device 52. The detonator 10 is charged by the power supply device 52. The detonator 10 then exits through an exit of the cylindrical body 52*a* by the detonator loading unit 51. As a result, the detonator 10 moves linearly and penetrates the cylindrical body 52 so as to be loaded into the blast hole 72.

Another embodiment of the present disclosure will be described according to FIG. 12. A wireless detonation system 90 according to the third embodiment includes a relay device 91 shown in FIG. 12, instead of the relay device 30 of the wireless detonation system 1 shown in FIG. 3. The relay device 91 includes a cylindrical housing 92 having a front end 92*a* at one end and a rear end 92*b* at the other end. The rear end 92*b* is disposed at an inner end of the insertion hole 74, so as to have substantially the same depth as the detonator 10, when the detonator 10 is inserted into the blast hole 72. The front end 92*a* is accommodated within an interior of the insertion hole 74 and disposed in front of the rear end 92*b*.

Figure 12:
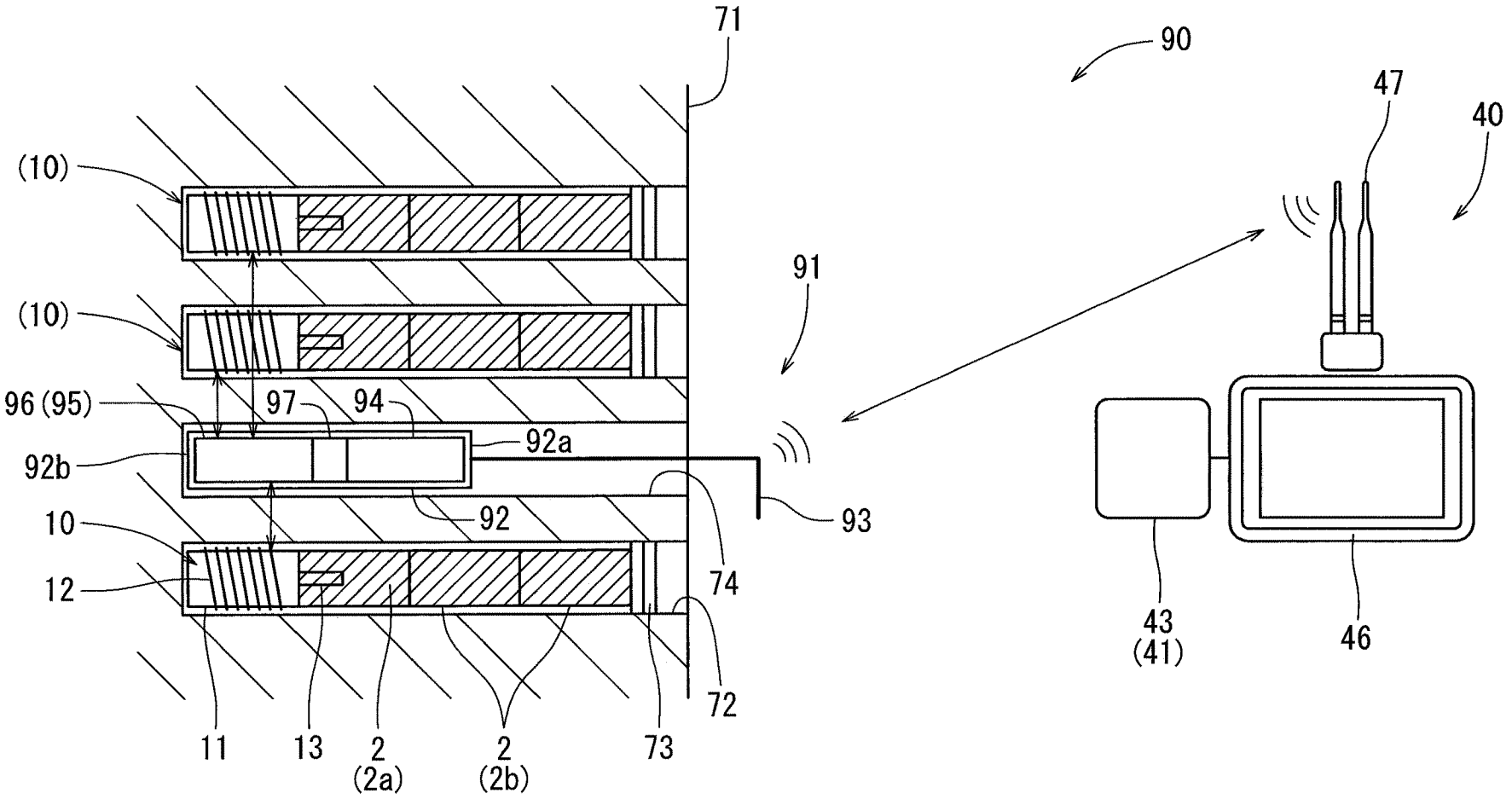
FIG. 12 is a schematic diagram of a detonator, a relay device, and a blasting operation device according to a third embodiment.

As show in FIG. 12, the relay device 91 includes a first transmitting-receiving antenna 93 at the front end 92*a*, and includes a second transmitting-receiving antenna 95 at the rear end 92*b*. The first transmitting-receiving antenna 93 extends to the front side of the insertion hole 74 and projects beyond the entrance of the insertion hole 74. The first transmitting-receiving antenna 93 transmits and/or receives radio waves within the frequency range of, for example, 1 MHz to 10 GHz. It is typically difficult for frequencies within this range to penetrate soil and bedrock. The first transmitting-receiving antenna 93 preferably transmits and/or receives radio waves with a frequency of 100 MHz or higher, for example 920 MHz. The second transmitting-receiving antenna 95 transmits and/or receives radio waves within a frequency range of, for example, 1 kHz to 500 kHz. It is typically easy for frequencies within this range to penetrate soil and bedrock. The second transmitting-receiving antenna 95 preferably transmits and/or receives radio waves with a frequency of, for example, 200 kHz.

As shown in FIG. 12, the relay device 91 includes a first modem 94 disposed at a front end 92*a* side and a second modem 96 disposed at a rear end 92*b* side. A relay processor 97 and a power source (not shown) are provided between the first modem 94 and the second modem 96. The relay processor 97 processes received input signals and processes to transmit signals at a different frequency than the frequency of the received signals. The first modem 94 demodulates analog signals received by the first transmitting-receiving antenna 93 into digital signals. The first modem 94 modulates digital signals transmitted from the second modem 96 via the relay processor 97 into analog signals. The second modem 96 demodulates analog signals received by the second transmitting-receiving antenna 95 into digital signals. The second modem 96 modulates digital signals transmitted from the first modem via the relay processor 97 into analog signals.

According to the above-described wireless detonation system 90, as shown in FIG. 12, the front end 92*a* of the housing 92 is accommodated and disposed within the interior of the insertion hole 74. The first transmitting-receiving antenna 93 extends from the front end 92*a* to the entrance of the insertion hole 74, so as to project beyond the entrance of the insertion hole 74. Therefore, it is possible to transmit and/or receive signals with the first frequency within a range of, for example, 1 MHz to 10 GHz, between the relay device 91 disposed at the rear side of the insertion hole 74 and the blasting operation device 40 outside the insertion hole 74. It is typically difficult for frequencies within this range to penetrate soil and bedrock. In addition, the housing 92 can be made more compact with respect to the insertion hole 74. This makes it easier to insert and dispose the relay device 91 within the insertion hole 74.

Another embodiment of the present disclosure will be described according to FIG. 13. The wireless detonation system 100 of the fourth embodiment includes the relay device 101 shown in FIG. 13, instead of the relay device 30 of the wireless detonation system 1 shown in FIG. 3. Further, the wireless detonation system 100 includes a second relay device 108. The relay device 101 is configured similarly to the relay device 91 shown in FIG. 12. The rear end 102*b* of the housing 102 of the relay device 101 is disposed in the inner end of the insertion hole 74. The front end 102*a* of the housing 102 is accommodated within the interior of the insertion hole 74 and is disposed in front of the rear end 102*b*. A first transmitting-receiving antenna 103, which is configured to transmit and receive radio waves within the frequency range of, for example, 1 MHz to 10 GHz, preferably 100 MHz or higher, for example 920 MHz, is provided at the front end 102*a*. A second transmitting-receiving antenna 105, which is configured to transmit and receive radio waves within the frequency range of, for example, 1 kHz to 500 kHz, preferably, for example, 200 kHz, is provided at the rear end 102*b*.

Figure 13:
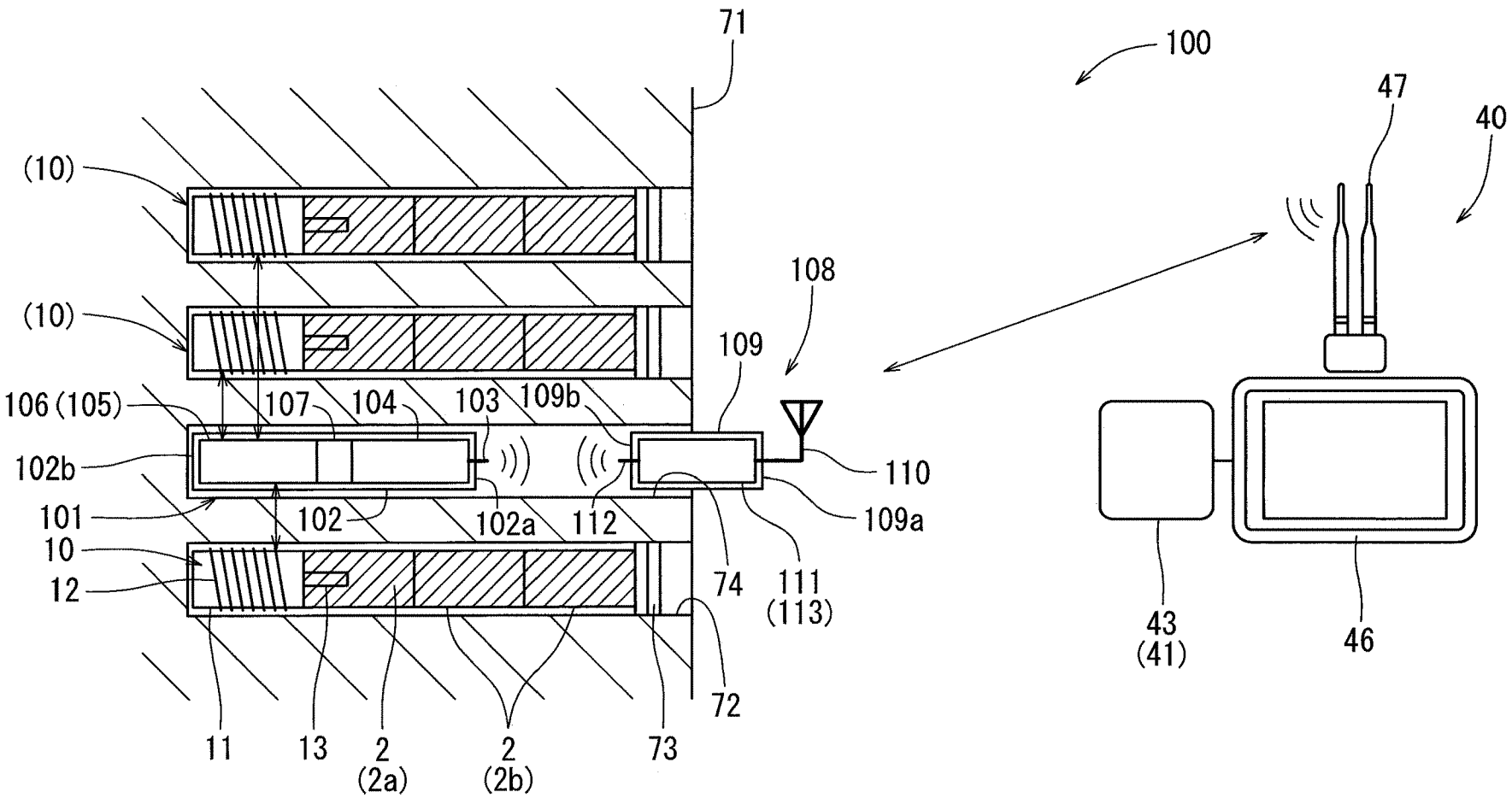
FIG. 13 is a schematic diagram of a detonator, a relay device, and a blasting operation device according to a fourth embodiment.

As shown in FIG. 13, the relay device 101 includes a first modem 104 disposed at a front end 102*a* side, a second modem 106 disposed at a rear end 102*b* side, a relay processor 107 disposed therebetween, and a power source (not shown). The relay processor 107 processes received input signals and processes to transmit signals having a different frequency than that received. The first modem 104 and the second modem 106 demodulate analog signals received by the first transmitting-receiving antenna 103 and the second transmitting-receiving antenna 105, respectively, into digital signals. The first modem 104 and the second modem 106 modulate digital signals transmitted from the second modem 106 and the first modem 104, respectively, via the relay processor 107 into analog signals.

As shown in FIG. 13, the second relay device 107 is disposed at the entrance of the insertion hole 74. The second relay device 108 has a cylindrical housing 109. The housing 109 includes a front end 109*a* disposed at a location projecting from the entrance of the insertion hole 74 and a rear end 109*b* disposed at the rear side of the entrance of the insertion hole 74. The first transmitting-receiving antenna 110 is provided at the front end 109*a* and the second transmitting-receiving antenna 112 is provided at the rear end 109*b*. The first transmitting-receiving antenna 110 and the front end 109*a* project from the entrance of the insertion hole 74. The first transmitting-receiving antenna 110 and the second transmitting-receiving antenna 112 transmit and/or receive radio waves at frequencies that do not easily penetrate soil and bedrock, of for example, frequencies within the range of 1 MHz to 10 GHz, preferably, 100 MHz or higher, for example 920 MHz.

As shown in FIG. 13, the second relay device 108 includes a modem 111, a relay processor 113, and a power source (not shown). The modem 111 demodulates analog signals received by the first transmitting-receiving antenna 110 and/or the second transmitting-receiving antenna 112 into digital signals. The relay processor 113 processes the signals input by the modem 111 and regenerates signals at the same frequency band to be transmitted. The modem 111 modulates digital signals transmitted from the relay processor 113 into analog signals. The modulated signals are transmitted from the first transmitting-receiving antenna 110 and/or the second transmitting-receiving antenna 112.

According to the above-described wireless detonation system 100, as shown in FIG. 13, the front end 102*a* of the housing 102 is accommodated and disposed within the interior of the insertion hole 74. The second relay device 108 is disposed at the entrance of the insertion hole 74. The housing 109 of the second relay device 108 has its front end 109*a* projecting from the entrance of the insertion hole 74 and its rear end 109*b* accommodated within the interior of the insertion hole 74. Therefore, it is possible to more easily transmit and/or receive signals having the first frequency, which is a frequency that does not easily penetrate soil and bedrock, between the relay device 91 disposed at the rear side of the insertion hole 74 and the blasting operation device 40 positioned outside the insertion hole 74. In addition, the housing 102 can be made compact with respect to the insertion hole 74. This makes it easier to insert the relay device 101 into the insertion hole 74 so as to be positioned at a rear side thereof.

Although one embodiment has been described with reference to the above structure, it is obvious to those skilled in the art that various replacements, improvements, and/or variations can be made without departing from the object of one embodiment of the present disclosure. Therefore, one embodiment of the present disclosure may include all replacements, improvements, and variations without departing from the gist and the object of attached claims. For example, one embodiment of the present disclosure shall not limited to the specific structure, and may instead be modified, examples of which will be described below.

For example, the wireless detonation systems 1, 80 may be used for tunnel 70 excavation work, as described above. Alternatively, they may be applied, for example, to demolition of structures, such as buildings, or excavation of the seabed. The detonator 10 according to the above-described embodiments include a receiving coil 12 that also serves as a transmitting-receiving antenna. Alternatively, the detonator 10 may include a transmitting-receiving antenna different from the receiving coil 12 or a receiving antenna and a transmitting antenna different from the receiving coil 12. The receiving antenna and a transmitting antenna may be separated from each other. Similarly, the relay device may include first and second receiving antennas and first and second transmitting antennas, which are separated from each other alternative to the first transmitting-receiving antenna 35 and the second transmitting-receiving antenna 37. The blasting operation device 40 may include a receiving antenna and a transmitting antenna, which are separated from each other alternative to the transmitting-receiving antenna 47.

The loading-unit-side communication device 55 according to the above-described embodiments may include a power supplying coil 53, which may also serve as a transmitting-receiving antenna. Alternatively, the loading-unit-side communication device 55 may also include an antenna different from the power supplying coil 53 or a receiving antenna and a transmitting antenna different from the power supplying coil 53. The receiving antenna and transmitting antenna may be separated from each other. Similarly, the relay device 81 may include, for example, a second transmitting-receiving antenna different from the receiving coil 85, or include a second receiving antenna and a second transmitting antenna, which are separated from each other alternative to the receiving coil 85.

The relay device 30 according to the above-described embodiments include a housing 31 in which the first transmitting-receiving antenna 35, the second transmitting-receiving antenna 37, and the control circuit 32 having the relay processor are integrally provided within the housing 31. Alternatively, the relay device 30 may be configured to have, for example, three housings. Each of the first transmitting-receiving antenna 35, the second transmitting-receiving antenna 37, and the control circuit 32 may be provided to any of the three housings.

The loading-unit-side communication device 55 according to the above-described embodiments is attached to the detonator loading unit 51. Alternatively, the loading-unit-side communication device 55 may be, for example, a handy-type separated from the detonator loading unit 51. The detonator loading unit 51 may also include a plurality of loading-unit-side communication devices 55. The detonator loading unit 51 and the explosive delivery unit 50 may be separate. An operator may also perform the work of charging and loading the detonator 10 into the blast hole nearby by operating the detonator loading unit 51. Alternatively, this work may perform automatically in accordance with programs that are prepared in advance.

The detonator 10 according to the above-described embodiments includes single storage circuit 25. Alternatively, the detonator 10 may include, for example, two storage circuits 25. This, for example, allows energy for driving each electronic component to be stored in one storage circuit 25 and energy for igniting the detonator ignition part 13 to be stored in another storage circuit 25. The detonator 10 may be, for example, of a non-rechargeable type having a power source in which the electric power is stored in advance. A power source for the relay devices 91, 101 and the second relay device 108 may be either of a rechargeable type or a non-rechargeable type. The illustrated second relay device 108 regenerates and processes to transmit received signals with the same second frequency as that received. Alternatively, the second relay device 108 may instead transmit received signals directly inward or outward of the insertion hole 74. More than the one relay device(s) 30, 81 may be used for one blasting operation. Radio signals at the first frequency may be the same for the upward and downward communications. Alternatively, the upward and downward communications may be different frequencies within the range of, for example, 1 MHz to 10 GHz. Radio signals at the second frequency may be the same for upward and downward communications. Alternatively, the upward and downward communications may be different frequencies within the range of, for example, 1 kHz to 500 kHz. The relay device 30 may be configured to be arranged, for example, only at the front end of the insertion hole 74.

The invention claimed is:

1. A wireless detonation system, comprising:

a blasting operation device disposed at a distanced from a blasting target, the blasting operation device being configured to wirelessly transmit a first downstream signal at a first frequency;

a detonator loaded in a blast hole of the blasting target, the detonator including an explosive-side receiving antenna configured to wirelessly receive a second downstream signal at a second frequency lower than the first frequency; and a relay device including a first receiving antenna configured to wirelessly receive the first downstream signal, a relay processor configured to process the wirelessly received first downstream signal and configured to process the second downstream signal to be wirelessly transmitted at the second frequency, and a second transmitting antenna configured to wirelessly transmit the second downstream signal, wherein the second transmitting antenna is positioned within an insertion hole of the blasting target, the insertion hole being aligned with the blast hole.

2. The wireless detonation system according to claim 1, wherein the detonator includes an explosive-side transmitting antenna configured to wirelessly transmit a second upstream signal at the second frequency, wherein the relay device includes a second receiving antenna to wirelessly receive the second upstream signal and a first transmitting antenna configured to wirelessly transmit the first upstream signal, wherein the relay processor is configured to process the wirelessly received second upstream signal and to process the first downstream signal to be wirelessly transmitted at the first frequency, and wherein the blasting operation device is configured to wirelessly receive the first upstream signal.

3. The wireless detonation system according to claim 2, wherein:

the explosive-side receiving antenna and the explosive-side transmitting antenna are a common antenna, the first receiving antenna and the first transmitting antenna are a common antenna, and the second receiving antenna and the second transmitting antenna are a common antenna.

4. The wireless detonation system according to claim 1, wherein:

the relay device includes a housing which is partially or entirely inserted into the insertion hole, wherein the first receiving antenna, a second receiving antenna, and the relay processor are integrally provided in the housing, or the relay device includes a plurality of housings to be inserted into the insertion holes, wherein the first receiving antenna is provided to any of the plurality of housings, the second transmitting antenna is provided to any of the plurality of housings, and the relay processor is provided to any of the plurality of housings.

5. The wireless detonation system according to claim 4, wherein:

the housing has a rear end provided at a rear side of the insertion hole, the second transmitting antenna is provided at the rear end, and the first receiving antenna is provided at a front end of the housing opposite to the rear end.

6. The wireless detonation system according to claim 5, wherein the front end of the housing and the first receiving antenna project out of the insertion hole.

7. The wireless detonation system according to claim 1, wherein:

the second frequency is a frequency within a range of 1 kHz to 500 kHz, and the first frequency is a frequency within a range of 1 MHz to 10 GHz.

8. The wireless detonation system according to claim 1, further comprising a detonator loading unit configured to load the detonator into the blast hole, wherein:

the detonator loading unit includes a loading-unit-side communication device configured to wirelessly communicate with the explosive-side receiving antenna of the detonator before the detonator is loaded into the blast hole at the second frequency.

9. The wireless detonation system according to claim 8, wherein:

the detonator includes a receiving coil configured to receive energy for powering the detonator and a capacitor for storing the received energy the detonator loading unit includes a power supplying coil configured to feed energy to the receiving coil of the detonator before the detonator is loaded into the blast hole.

10. The wireless detonation system according to claim 8, wherein the detonator loading unit is provided to an explosive delivery unit configured to deliver explosives to be loaded into the blast hole.

11. A relay device for a wireless detonation system, comprising:

a first receiving antenna configured to wirelessly receive a first downstream signal at a first frequency from a blasting operation device disposed distanced from a blasting target;

a relay processor configured to process the received first downstream signal and to process a second downstream signal to be wirelessly transmitted at second frequency lower than the first frequency;

a second transmitting antenna configured to wirelessly transmit the second downstream signal to an explosive-side receiving antenna of a detonator that has been loaded in a blast hole of the blasting target; and a housing to which the first receiving antenna, the relay processor, and the second transmitting antenna are attached, wherein the housing is loaded in an insertion hole of the blasting target aligned with the blast hole.

12. The relay device for the wireless detonation system according to claim 11, further comprising:

a second receiving antenna configured to wirelessly receive a second upstream signal transmitted from the detonator at the second frequency; and a first transmitting antenna configured to wirelessly transmit the first upstream signal, wherein the relay processor is further configured to process the wirelessly received second upstream signal and to process the first upstream signal to be wirelessly transmitted at the first frequency, and wherein the second receiving antenna, the relay processor, and the first transmitting antenna are attached to the housing.

13. The relay device for the wireless detonation system according to claim 12, wherein:

the first receiving antenna and the first transmitting antenna are a common antenna, and the second receiving antenna and the second transmitting antenna are a common antenna.

14. The relay device for the wireless detonation system according to claim 11, wherein:

the second transmitting antenna is provided at a rear end of the housing disposed at a rear side of the insertion hole, and the first receiving antenna is provided at a front end of the housing opposite to the rear end.

15. The relay device for the wireless detonation system according to claim 14, wherein the front end of the housing and the first receiving antenna project out of the insertion hole.

16. The relay device for the wireless detonation system according to claim 11, wherein:

the second frequency is a frequency within a range of 1 kHz to 500 kHz, and the first frequency is a frequency in a range of 1 MHz to 10 GHz.

17. A wireless detonation method using a wireless detonation system, the wireless detonation method comprising the steps of:

communicating a blasting operation device and a first antenna of a relay device with each other using wireless signals at a first frequency within a range of 1 MHz to 10 GHZ, wherein the blasting operation device is disposed in a position distanced from a blasting target, and wherein the relay device is disposed at least partially within an insertion hole of the blasting target;

communicating a detonator and a second antenna of the relay device with each other using wireless signals at a second frequency within a range of 1 kHz to 500 kHz, wherein the detonator is disposed within a blast hole of the blasting target;

receiving signals at the first frequency and transmitting signals at the second frequency using the relay device; and receiving signals at the second frequency and transmitting signals at the first frequency using the relay device.

18. The wireless detonation method according to claim 17, wherein:

the blasting operation device wirelessly transmits a first downstream signal to the relay device at the first frequency, and the relay device wirelessly transmits a second downstream signal to the detonator at the second frequency.

19. The wireless detonation method according to claim 17, wherein:

the detonator wirelessly transmits a second upstream signal at the second frequency to the relay device, a relay processor of the relay device processes the second upstream signal and processes a first upstream signal to be wirelessly transmitted at the first frequency, and the relay device transmits the first upstream signal to the blasting operation device.

20. The wireless detonation method according to claim 17, wherein:

a detonator loading unit feeds electric power to the detonator and the relay device in a wireless manner, the detonator loading unit loads the detonator into the blast hole of the blasting target once the detonator has been energized, and the detonator loading unit loads the relay device into the insertion hole of the blasting target once the relay device has been energized.

* * * * *